US009989876B2

(12) United States Patent
Morinaga et al.

(10) Patent No.: US 9,989,876 B2
(45) Date of Patent: Jun. 5, 2018

(54) IMAGE FORMING APPARATUS AND METHOD FOR CALCULATING A TONER DEGRADATION RATE

(71) Applicants: Mutsuki Morinaga, Kanagawa (JP); Tadashi Kasai, Duluth, GA (US); Jun Hitosugi, Tokyo (JP); Takamasa Ozeki, Kanagawa (JP); Makoto Yasuda, Kanagawa (JP); Kunio Hasegawa, Kanagawa (JP); Emiko Shiraishi, Tokyo (JP); Hitoshi Yamamoto, Kanagawa (JP); Masahiko Shakuto, Kanagawa (JP); Tetsuya Muto, Tokyo (JP); Keiko Kajimura, Ohta-ku (JP); Tomoya Ohsugi, Kanagawa (JP)

(72) Inventors: Mutsuki Morinaga, Kanagawa (JP); Tadashi Kasai, Duluth, GA (US); Jun Hitosugi, Tokyo (JP); Takamasa Ozeki, Kanagawa (JP); Makoto Yasuda, Kanagawa (JP); Kunio Hasegawa, Kanagawa (JP); Emiko Shiraishi, Tokyo (JP); Hitoshi Yamamoto, Kanagawa (JP); Masahiko Shakuto, Kanagawa (JP); Tetsuya Muto, Tokyo (JP); Keiko Kajimura, Ohta-ku (JP); Tomoya Ohsugi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/296,542

(22) Filed: Oct. 18, 2016

(65) Prior Publication Data

US 2017/0199480 A1 Jul. 13, 2017

(30) Foreign Application Priority Data

Jan. 13, 2016 (JP) ..... 2016-004444
Mar. 23, 2016 (JP) ..... 2016-058886

(51) Int. Cl.
*G03G 15/08* (2006.01)
*G03G 15/01* (2006.01)
*G03G 15/00* (2006.01)

(52) U.S. Cl.
CPC ..... *G03G 15/0131* (2013.01); *G03G 15/0849* (2013.01); *G03G 15/5058* (2013.01);
(Continued)

(58) Field of Classification Search
CPC ..... G03G 15/5058; G03G 15/556; G03G 2215/00059
(Continued)

(56) References Cited

U.S. PATENT DOCUMENTS 7,149,439 B2 * 12/2006 Hirata ..... G03G 15/5058 399/29
7,593,655 B2 * 9/2009 Nishida ..... G03G 15/1675 399/49
(Continued)

FOREIGN PATENT DOCUMENTS

EP 1321827 A2 * 6/2003 ..... G03G 13/01
JP 2000056641 A * 2/2000
(Continued)

*Primary Examiner* — Robert Beatty
(74) *Attorney, Agent, or Firm* — Oblon, McClelland, Maier & Neustadt, L.L.P.

(57) ABSTRACT

An image forming apparatus includes a toner pattern bearer to bear a first toner pattern having a first image area and a second toner pattern having a second image area different from the first image area. A toner adhesion amount detector detects a toner adhesion amount of toner of each of the first toner pattern and the second toner pattern. A toner degra-
(Continued)

dation rate calculator calculates a first deviation in the toner adhesion amount of the first toner pattern and a second deviation in the toner adhesion amount of the second toner pattern based on the toner adhesion amount detected by the toner adhesion amount detector. The toner degradation rate calculator compares the first deviation with the second deviation and calculates a toner degradation rate based on a comparison result.

20 Claims, 14 Drawing Sheets

(52) U.S. Cl.
CPC ..... *G03G 15/55* (2013.01); *G03G 15/556* (2013.01); *G03G 15/0189* (2013.01); *G03G 2215/00059* (2013.01); *G03G 2215/0164* (2013.01)

(58) Field of Classification Search
USPC ..... 399/49
See application file for complete search history.

(56) References Cited

U.S. PATENT DOCUMENTS

| | | | | |
|---|---|---|---|---|
| 8,005,379 | B2 * | 8/2011 | Harashima ..... | G03G 15/0131 399/49 |
| 8,606,133 | B2 * | 12/2013 | Higa ..... | G03G 15/0848 399/302 |
| 2011/0110676 | A1 | 5/2011 | Higa | |
| 2014/0341597 | A1 | 11/2014 | Urayama et al. | |
| 2014/0348521 | A1 | 11/2014 | Mase et al. | |
| 2015/0037054 | A1 * | 2/2015 | Nagata ..... | G03G 15/1665 399/49 |
| 2015/0139668 | A1 | 5/2015 | Sugiyama et al. | |
| 2015/0316885 | A1 | 11/2015 | Uematsu et al. | |
| 2016/0070198 | A1 | 3/2016 | Morinaga et al. | |
| 2016/0147174 | A1 | 5/2016 | Yasuda et al. | |

FOREIGN PATENT DOCUMENTS

| | | | | |
|---|---|---|---|---|
| JP | 2009168906 | A * | 7/2009 | |
| JP | 2011-107207 | | 6/2011 | |
| JP | 2011107207 | A * | 6/2011 | ..... G03G 15/1675 |
| JP | 2011154090 | A * | 8/2011 | |

* cited by examiner

FIG. 13

| AS FREQUENCY AND DUTY CYCLE INCREASE | DEVELOPING $\gamma$ | AVAILABLE DEVELOPING POTENTIAL | HALO | UNEVEN COLOR |
|---|---|---|---|---|
| FREQUENCY [Hz] | ↖ | ↖ | ↗ | ↖ |
| DUTY CYCLE [%] | ↑ | ↗ | ↗ | ↗ |

IMAGE FORMING APPARATUS AND METHOD FOR CALCULATING A TONER DEGRADATION RATE

CROSS-REFERENCE TO RELATED APPLICATIONS

This patent application is based on and claims priority pursuant to 35 U.S.C. § 119 to Japanese Patent Application Nos. 2016-004444, filed on Jan. 13, 2016, and 2016-058886, filed on Mar. 23, 2016, in the Japanese Patent Office, the entire disclosure of each of which is hereby incorporated by reference herein.

BACKGROUND

Technical Field

Exemplary embodiments generally relate to an image forming apparatus and an image forming method, and more particularly, to an image forming apparatus for forming a toner image on a recording medium and an image forming method performed by the image forming apparatus.

Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

While a toner image having a small image area is formed on a plurality of recording media continuously, toner of the toner image may degrade due to repeated stress caused by excessive sliding, agitation, and the like. To address this circumstance, the image forming apparatus may detect a toner degradation rate of the degraded toner. The image forming apparatus changes an image forming condition based on the detected toner degradation rate so as to suppress variation in a toner density of the toner image.

SUMMARY

This specification describes below an improved image forming apparatus. In one exemplary embodiment, the image forming apparatus includes an image bearer and a toner image forming device to form a first toner image and a second toner image on the image bearer. A toner pattern bearer is rotatable in a predetermined direction of rotation. A transferor transfers the first toner image onto a first position on the toner pattern bearer as a first toner pattern having a first image area and transfers the second toner image onto a second position on the toner pattern bearer as a second toner pattern having a second image area different from the first image area. The second position is spaced apart from the first position in the direction of rotation of the toner pattern bearer. A toner adhesion amount detector detects a toner adhesion amount of toner of each of the first toner pattern and the 15 second toner pattern at a plurality of different positions aligned in a direction perpendicular to the direction of rotation of the toner pattern bearer. A toner degradation rate calculator calculates a first deviation in the toner adhesion amount of the first toner pattern and a second deviation in the toner adhesion amount of the second toner pattern based on the toner adhesion amount detected by the toner adhesion amount detector at the plurality of different positions. The toner degradation rate calculator compares the first deviation with the second deviation and calculates a toner degradation rate based on a comparison result.

This specification further describes below an improved image forming method. In one exemplary embodiment, the image forming method includes forming a first toner pattern having a first image area and a second toner pattern having a second image area smaller than the first image area on a toner pattern bearer; detecting a toner adhesion amount of toner adhered to the first toner pattern and the second toner pattern at a plurality of positions aligned on each of the first toner pattern and the second toner pattern in a main scanning direction perpendicular to a direction of rotation of the toner pattern bearer; calculating a difference between a first deviation in the toner adhesion amount of the first toner pattern and a second deviation in the toner adhesion amount of the second toner pattern in the main scanning direction; calculating a toner degradation rate based on the calculated difference; and determining a developing condition to form a toner image based on the calculated toner degradation rate.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 13 is a diagram illustrating change in the uneven color and a Halo and change in a developing γ and an available developing potential if the controller depicted in FIG. 2 increases each parameter of a developing condition;

Figure 1:
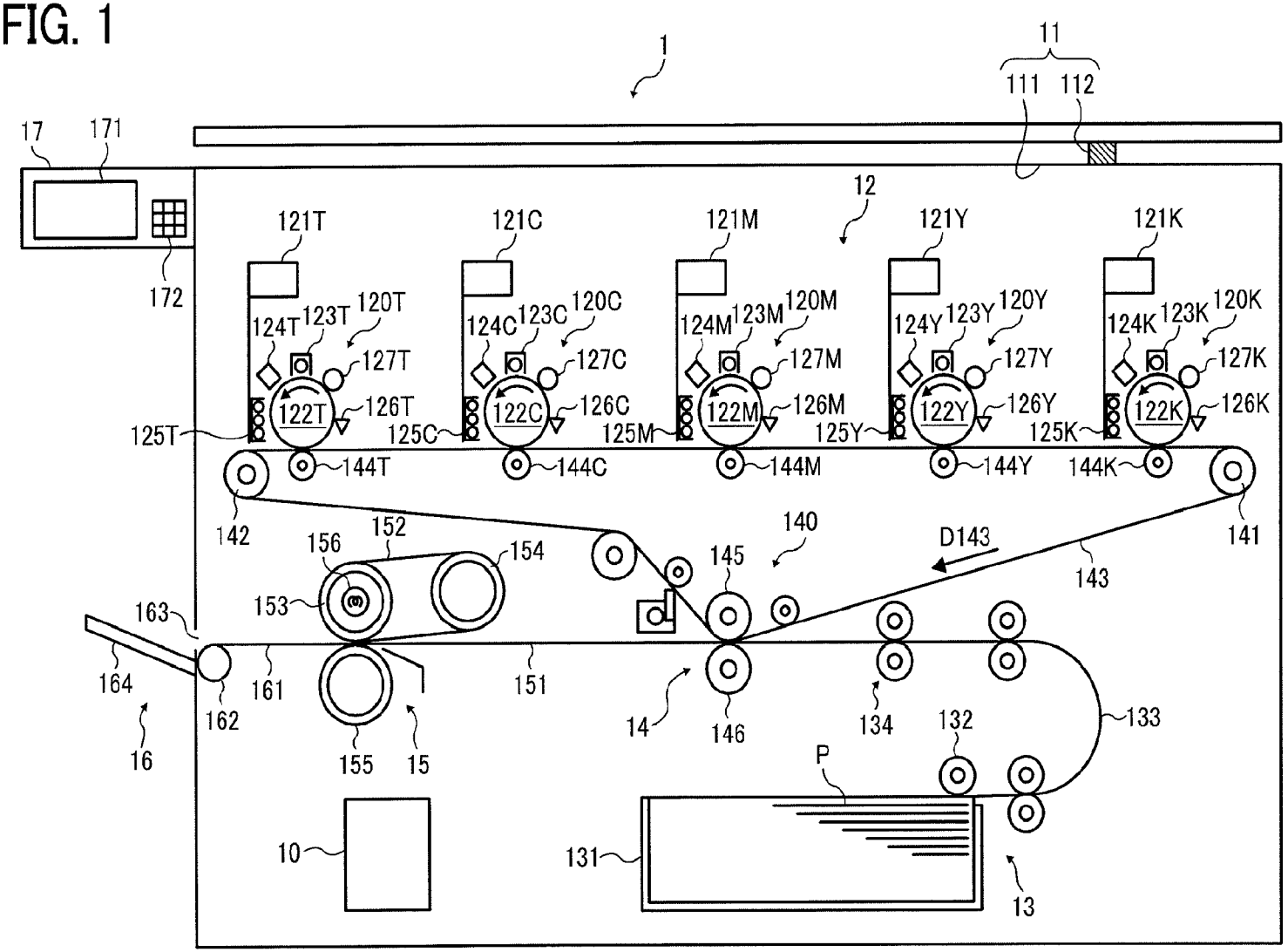
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MEP) having at least one of copying, printing, scanning, facsimile, and plotter functions, or the like. According to this exemplary embodiment, the image forming apparatus 1 is a color copier that forms color and monochrome toner images on recording media by electrophotography. Alternatively, the image forming apparatus 1 may be a monochrome copier that forms monochrome toner images.

Referring to FIG. 1, a description is provided of a construction of the image forming apparatus 1.

The image forming apparatus 1 is a tandem color laser copier incorporating a plurality of latent image bearers arranged in a predetermined direction.

The image forming apparatus 1 fixes an unfixed toner image on a sheet P serving as one example of a recording medium to form a toner image on the sheet P. As illustrated in FIG. 1, the image forming apparatus 1 includes a controller 10, an image reader 11, an image forming device 12, a sheet feeder 13, a transfer device 14, a fixing device 15, an output device 16, and a control panel 17.

A detailed description is now given of a configuration of the controller 10.

Figure 2:
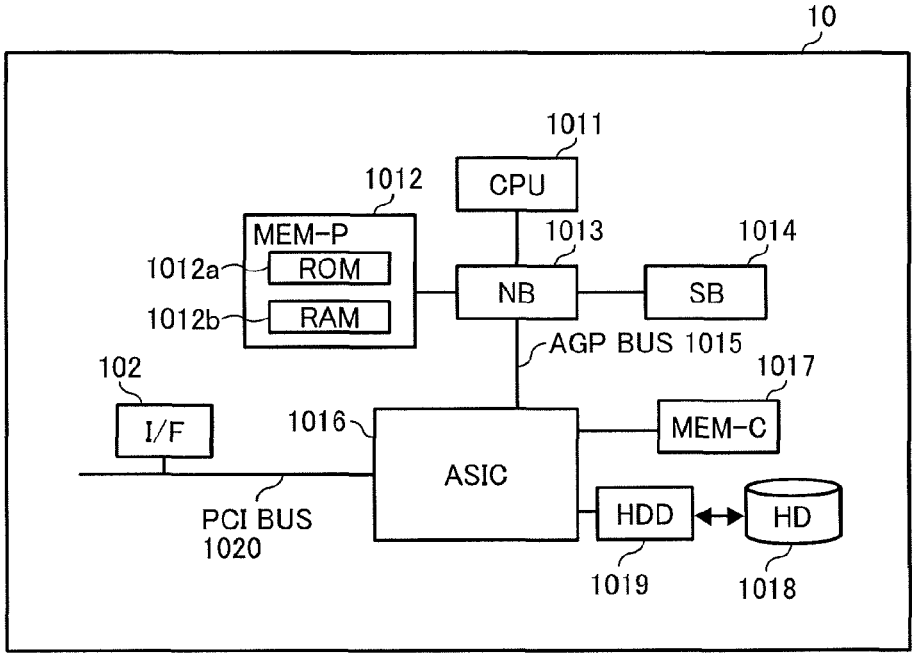
FIG. 2 is a block diagram of a controller incorporated in the image forming apparatus depicted in FIG. 1.

FIG. 2 is a block diagram of the controller 10. As illustrated in FIG. 2, the controller 10 includes a central processing unit (CPU) 1011 serving as a toner degradation rate calculator, a main memory (MEM-P) 1012, a north bridge (NB) 1013, a south bridge (SB) 1014, an accelerated graphics port (AGP) bus 1015, an application specific integrated circuit (ASIC) 1016, a local memory (MEM-C) 1017, a hard disk (HD) 1018, a hard disk drive (HDD) 1019, a peripheral component interconnect (PCI) bus 1020, and a network interface (I/F) 102.

The CPU 1011 performs data processing and calculation according to a program stored in the main memory 1012 and controls an operation of the image reader 11, the image forming device 12, the sheet feeder 13, the transfer device 14, the fixing device 15, and the output device 16 depicted in FIG. 1. The main memory 1012 is a memory of the controller 10 and includes a read only memory (ROM) 1012*a* and a random access memory (RAM) 1012*b*. The ROM 1012*a* is a memory that stores a program and data actuating various functions of the controller 10. Alternatively, the program stored in the ROM 1012*a* may be stored in a computer readable, recording medium, such as a compact disc read only memory (CD-ROM), a floppy disk (FD), a compact disc recordable (CD-R), and a digital versatile disc (DVD), in a file format installable or executable.

The RAM 1012*b* is a memory that develops the program and data, a drawing memory that is used for printing, and the like. The NB 1013 is a bridge that interconnects the CPU 1011, the main memory 1012, the SB 1014, and the AGP bus 1015. The SB 1014 is a bridge that interconnects the NB 1013, a peripheral component interconnect (PCI) device, and a peripheral device. The AGP bus 1015 is a bus interface for a graphics accelerator card that accelerates graphic processing.

The ASIC 1016 includes a peripheral component interconnect (PCI) target, an accelerated graphics port (AGP) master, an arbiter (ARB) serving as a core of the ASIC 1016, a memory controller that controls the local memory 1017, and a plurality of direct memory access controllers (DMAC) that rotates an image by hardware logic or the like. The ASIC 1016 is connected to a universal serial bus (USB) interface and an institute of electrical and electronics engineers (IEEE) 1394 interface through the PCI bus 1020.

The local memory 1017 is used as an image buffer for copying and a code buffer. The HD 1018 is a storage that stores image data, font data used for printing, and form data. The HDD 1019 controls reading or writing of data with respect to the HD 1018 under control of the CPU 1011. The network I/F 102 sends and receives data to and from an external device such as a data processor via a communication network.

A detailed description is now given of a construction of the image reader 11 depicted in FIG. 1.

The image reader 11 optically reads an image on an original to create image data. For example, the image reader 11 irradiates the original with light. A charge coupled device (CCD) or a reading sensor such as a contact image sensor (CIS) receives the light reflected by the original and reads the light into image data. The image data is information defining a toner image to be formed on a sheet P and is constructed of electrical color separation image signals indicating red (R), green (G), and blue (B), respectively.

As illustrated in FIG. 1, the image reader 11 includes an exposure glass 111 and a reading sensor 112. The original bearing the image is placed on the exposure glass 111. The reading sensor 112 reads the image on the original placed on the exposure glass 111 into image data.

A detailed description is now given of a construction of the image forming device 12.

The image forming device 12 adheres toner to an outer circumferential surface of an intermediate transfer belt 143 serving as a toner pattern bearer of the transfer device 14 according to the image data created by the image reader 11 or image data received by the network I/F 102 depicted in FIG. 2, thus forming the toner image on the outer circumferential surface of the intermediate transfer belt 143.

The image forming device 12 includes image forming units 120C, 120M, 120Y, 120K, and 120T serving as toner image forming units that form toner images with developers in different colors, respectively. For example, the image forming unit 120C forms a cyan toner image with cyan toner. The image forming unit 120M forms a magenta toner image with magenta toner. The image forming unit 120Y forms a yellow toner image with yellow toner. The image forming unit 120K forms a black toner image with black toner. The image forming unit 120T forms a clear toner image with clear toner.

At least one of the cyan toner, the magenta toner, the yellow toner, and the black toner is hereinafter referred to as colored toner. The colored toner includes charged resin particles containing a coloring material such as a pigment and a dye.

The clear toner is colorless, transparent toner. If the clear toner adheres to the colored toner adhered to a sheet P, a user sees the colored toner through resin particles of the clear toner. If the clear toner adheres to the sheet P, the user sees the sheet P through the resin particles of the clear toner. For example, the clear toner is prepared by adding silicon dioxide ($SiO_2$) and titanium dioxide ($TiO_2$) as an external additive to polyester resin having a low molecular weight. Alternatively, the clear toner may contain a coloring material in an amount that allows the user to see the sheet P or the colored toner adhered to the sheet P. An arbitrary image forming unit selected from the image forming units 120C, 120M, 120Y, 120K, and 120T is hereinafter referred to as an image forming unit 120.

The image forming unit 120C includes a toner supply 121C, a photoconductive drum 122C serving as an image bearer, a charger 123C, an exposure device 124C, a developing device 125C, a discharger 126C, and a cleaner 127C.

The toner supply 121C contains the cyan toner to be supplied to the developing device 125C. A conveying screw disposed inside the toner supply 121C is driven to convey a predetermined amount of the cyan toner to the developing device 125C.

The charger 123C uniformly changes an outer circumferential surface of the photoconductive drum 122C. The exposure device 124C forms an electrostatic latent image on the outer circumferential surface of the photoconductive drum 122C according to the image data sent from the controller 10. The developing device 125C adheres the cyan toner to the electrostatic latent image formed on the outer circumferential surface of the photoconductive drum 122C, visualizing the electrostatic latent image into a cyan toner image. The photoconductive drum 122C contacts the intermediate transfer belt 143 serving as a toner pattern bearer at a contact point where the photoconductive drum 122C rotates in accordance with rotation of the intermediate transfer belt 143.

The charger 123C uniformly changes the outer circumferential surface of the photoconductive drum 122C. The exposure device 124C irradiates the outer circumferential surface of the photoconductive drum 122C charged by the charger 123C with light according to a dot area rate (e.g., a halftone area rate) of the cyan toner image that is determined by the controller 10, thus forming the electrostatic latent image on the photoconductive drum 122C. The developing device 125C adheres the cyan toner supplied from the toner supply 121C to the electrostatic latent image formed on the outer circumferential surface of the photoconductive drum 122C by the exposure device 124C, visualizing the electrostatic latent image into the cyan toner image.

After the cyan toner image is primarily transferred onto the intermediate transfer belt 143, the discharger 126C discharges the outer circumferential surface of the photoconductive drum 122C. The cleaner 127C removes residual toner, failed to be transferred onto the intermediate transfer belt 143 and therefore remaining on the outer circumferential surface of the photoconductive drum 122C that is discharged by the discharger 126C, from the photoconductive drum 122C.

The image forming unit 120M includes a toner supply 121M, a photoconductive drum 122M serving as an image bearer, a charger 123M, an exposure device 124M, a developing device 125M, a discharger 126M, and a cleaner 127M. The toner supply 121M contains the magenta toner. Since the photoconductive drum 122M, the charger 123M, the exposure device 124M, the developing device 125M, the discharger 126M, and the cleaner 127M operate similarly to the photoconductive drum 122C, the charger 123C, the exposure device 124C, the developing device 125C, the discharger 126C, and the cleaner 127C, a description of an operation of the photoconductive drum 122M, the charger 123M, the exposure device 124M, the developing device 125M, the discharger 126M, and the cleaner 127M is omitted.

The image forming unit 120Y includes a toner supply 121Y, a photoconductive drum 122Y serving as an image bearer, a charger 123Y, an exposure device 124Y, a developing device 125Y, a discharger 126Y, and a cleaner 127Y. The toner supply 121Y contains the yellow toner. Since the photoconductive drum 122Y, the charger 123Y, the exposure device 124Y, the developing device 125Y, the discharger 126Y, and the cleaner 127Y operate similarly to the photoconductive drum 122C, the charger 123C, the exposure device 124C, the developing device 125C, the discharger 126C, and the cleaner 127C, a description of an operation of the photoconductive drum 122Y, the charger 123Y, the exposure device 124Y, the developing device 125Y, the discharger 126Y, and the cleaner 127Y is omitted.

The image forming unit 120K includes a toner supply 121K, a photoconductive drum 122K serving as an image bearer, a charger 123K, an exposure device 124K, a developing device 125K, a discharger 126K, and a cleaner 127K. The toner supply 121K contains the black toner. Since the photoconductive drum 122K, the charger 123K, the exposure device 124K, the developing device 125K, the discharger 126K, and the cleaner 127K operate similarly to the photoconductive drum 122C, the charger 123C, the exposure device 124C, the developing device 125C, the discharger 126C, and the cleaner 127C, a description of an operation of the photoconductive drum 122K, the charger 123K, the exposure device 124K, the developing device 125K, the discharger 126K, and the cleaner 127K is omitted.

The image forming unit 120T includes a toner supply 121T, a photoconductive drum 122T serving as an image bearer, a charger 123T, an exposure device 124T, a developing device 125T, a discharger 126T, and a cleaner 127T. The toner supply 121T contains the clear toner. Since the photoconductive drum 122T, the charger 123T, the exposure device 124T, the developing device 125T, the discharger 126T, and the cleaner 127T operate similarly to the photoconductive drum 122C, the charger 123C, the exposure device 124C, the developing device 125C, the discharger 126C, and the cleaner 127C, a description of an operation of the photoconductive drum 122T, the charger 123T, the exposure device 124T, the developing device 125T, the discharger 126T, and the cleaner 127T is omitted.

An arbitrary toner supply selected among the toner supplies 121C, 121M, 121Y, 121K, and 121T is hereinafter referred to as a toner supply 121. An arbitrary photoconductive drum selected among the photoconductive drums 122C, 122M, 122Y, 122K, and 122T is hereinafter referred to as a photoconductive drum 122. An arbitrary charger selected among the chargers 123C, 123M, 123Y, 123K, and 123T is hereinafter referred to as a charger 123. An arbitrary exposure device selected among the exposure devices 124C, 124M, 124Y, 124K, and 124T is hereinafter referred to as an exposure device 124. An arbitrary developing device selected among the developing devices 125C, 125M, 125Y, 125K, and 125T is hereinafter referred to as a developing device 125. An arbitrary discharger selected among the dischargers 126C, 126M, 126Y, 126K, and 126T is hereinafter referred to as a discharger 126. An arbitrary cleaner selected among the cleaners 127C, 127M, 127Y, 127K, and 127T is hereinafter referred to as a cleaner 127.

A detailed description is now given of a construction of the sheet feeder 13.

The sheet feeder 13 supplies a sheet P to the transfer device 14. The sheet feeder 13 includes a paper tray 131, a feed roller 132, a feed belt 133 serving as a recording medium conveyer, and a registration roller pair 134. The paper tray 131 loads a plurality of sheets P serving as one example of recording media and a toner image bearer. As the feed roller 132 rotates, the feed roller 132 moves a sheet P from the paper tray 131 to the feed belt 133. For example, the feed roller 132 picks up and feeds an uppermost sheet P of the plurality of sheets P loaded on the paper tray 131 onto the feed belt 133.

The feed belt 133 conveys the uppermost sheet P picked up by the feed roller 132 to a secondary transferor 140. The registration roller pair 134 feeds the sheet P conveyed by the feed belt 133 to the secondary transferor 140 at a time when a toner image formed on the intermediate transfer belt 143 reaches the secondary transferor 140.

A detailed description is now given of a construction of the transfer device 14.

The transfer device 14 primarily transfers a toner image formed on the photoconductive drum 122 by the image forming device 12 onto the intermediate transfer belt 143 and secondarily transfers the toner image transferred on the intermediate transfer belt 143 onto the sheet P.

The transfer device 14 includes a driving roller 141, a driven roller 142, the intermediate transfer belt 143, primary transfer rollers 144C, 144M, 144Y, 144K, and 144T, a secondary transfer roller 145, and a secondary transfer opposing roller 146. The intermediate transfer belt 143 is looped over the driving roller 141 and the driven roller 142. As a driver drives and rotates the driving roller 141, the driving roller 141 rotates the intermediate transfer belt 143 looped over the driving roller 141. The driving roller 141 and the driven roller 142 support the intermediate transfer belt 143. As the driving roller 141 rotates the intermediate transfer belt 143, the intermediate transfer belt 143 rotates the driven roller 142.

As the driving roller 141 rotates the intermediate transfer belt 143 looped over the driving roller 141 and the driven roller 142, the intermediate transfer belt 143 rotates in a rotation direction D143 while contacting the photoconductive drums 122. As the intermediate transfer belt 143 rotates while contacting the photoconductive drums 122, the cyan, magenta, yellow, black, and clear toner images formed on the photoconductive drums 122 are primarily transferred onto the outer circumferential surface of the intermediate transfer belt 143.

The primary transfer rollers 144C, 144M, 144Y, 144K, and 144T are disposed opposite the photoconductive drums 122C, 122M, 122Y, 122K, and 122T via the intermediate transfer belt 143, respectively. As the primary transfer rollers 144C, 144M, 144Y, 144K, and 144T rotate clockwise in FIG. 1, the primary transfer rollers 144C, 144M, 144Y, 144K, and 144T rotate the intermediate transfer belt 143 in the rotation direction D143. The secondary transfer roller 145 rotates while the secondary transfer roller 145 and the secondary transfer opposing roller 146 sandwich the intermediate transfer belt 143 and the sheet P. The secondary transfer opposing roller 146 rotates while the secondary transfer roller 145 and the secondary transfer opposing roller 146 sandwich the intermediate transfer belt 143 and the sheet P.

A detailed description is now given of a construction of the fixing device 15.

The fixing device 15 fixes the toner image secondarily transferred by the transfer device 14 on the sheet P. The fixing device 15 applies heat and pressure to the toner image on the sheet P to melt and fix a resin component of toner of the toner image on the sheet P. After the fixing device 15 fixes the toner image secondarily transferred by the transfer device 14 on the sheet P, the toner of the toner image on the sheet P attains a stable state.

A detailed description is now given of a construction of the fixing device 15.

The fixing device 15 includes a conveyance belt 151, a fixing belt 152, a fixing roller 153, a fixing belt driving roller 154, a fixing roller opposing roller 155, and a heater 156. The conveyance belt 151 conveys the sheet P bearing the toner image secondarily transferred by the transfer device 14 to a fixing nip formed between the fixing belt 152 and the fixing roller opposing roller 155. The fixing belt 152 is looped over the fixing roller 153 and the fixing belt driving roller 154. As the fixing roller 153 and the fixing belt driving roller 154 rotate, the fixing roller 153 and the fixing belt driving roller 154 rotate the fixing belt 152. While the sheet P is conveyed by the conveyance belt 151 through the fixing nip formed between the fixing belt 152 and the fixing roller opposing roller 155 that is disposed opposite the fixing roller 153 via the fixing belt 152, the fixing belt 152 and the fixing roller opposing roller 155 fix the toner image on the sheet P under heat and pressure.

The fixing belt driving roller 154 and the fixing roller 153 support the fixing belt 152. As the fixing belt driving roller 154 rotates, the fixing belt driving roller 154 rotates the fixing belt 152. The fixing roller opposing roller 155 is disposed opposite the fixing roller 153 via the fixing belt 152. The fixing belt 152 and the fixing roller opposing roller 155 sandwich the sheet P while the sheet P is conveyed through the fixing nip. The heater 156 is disposed inside the fixing roller 153 to heat the fixing roller 153 which heats the fixing belt 152. Thus, the fixing belt 152 heats the sheet P.

A detailed description is now given of a construction of the output device 16.

The output device 16 ejects the sheet P bearing the fixed toner image onto an outside of the image forming apparatus 1. The output device 16 includes an ejection belt 161, an ejection roller 162, an outlet 163, and an output tray 164. The ejection belt 161 conveys the sheet P bearing the fixed toner image to the outlet 163. The ejection roller 162 ejects the sheet P conveyed by the ejection belt 161 onto the output tray 164 through the outlet 163. The output tray 164 stacks the sheet P ejected by the ejection roller 162.

A detailed description is now given of a construction of the control panel 17.

The control panel 17 includes a display panel portion 171 and an operation portion 172. The display panel portion 171 displays settings, selection screens, and the like. The display panel portion 171 includes a touch panel with which the user inputs an instruction. The operation portion 172 includes ten keys with which the user inputs various settings for image formation and a start key with which the user inputs an instruction to start a print job.

A description is provided of deviation in a toner adhesion amount of toner adhered to the intermediate transfer belt 143, which occurs in a main scanning direction of the intermediate transfer belt 143.

Figure 3:
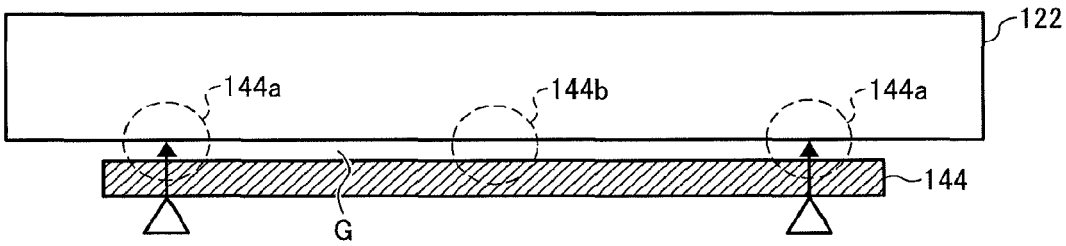
FIG. 3 is a schematic diagram of a photoconductive drum and a primary transfer roller incorporated in the image forming apparatus depicted in FIG. 1.

FIG. 3 is a schematic diagram of the photoconductive drum 122 and a primary transfer roller 144, illustrating a primary transfer nip formed between the photoconductive drum 122 and the intermediate transfer belt 143 depicted in FIG. 1. In FIG. 3, the primary transfer roller 144 represents each of the primary transfer rollers 144C, 144M, 144Y, 144K, and 144T depicted in FIG. 1.

As illustrated in FIG. 3, the primary transfer roller 144 is supported at both lateral ends of the primary transfer roller 144 in an axial direction thereof. For example, the primary transfer roller 144 includes two supported portions 144*a* disposed at both lateral ends of the primary transfer roller 144 in the axial direction thereof and a center portion 144*b* disposed at a center of the primary transfer roller 144 in the axial direction thereof. A gap G between the outer circumferential surface of the photoconductive drum 122 and an outer circumferential surface of the primary transfer roller 144 at the respective supported portions 144*a* is smaller than a gap G between the outer circumferential surface of the photoconductive drum 122 and the outer circumferential surface of the primary transfer roller 144 at the center portion 144*b*. Accordingly, primary transfer nip pressure exerted to the intermediate transfer belt 143 sandwiched between the photoconductive drum 122 and the primary transfer roller 144 at the gap G is greater at the respective supported portions 144*a* than at the center portion 144*b*. Consequently, a contact area where the primary transfer roller 144 contacts the intermediate transfer belt 143 is greater at the respective supported portions 144*a* than at the center portion 144*b*. A contact resistance between the primary transfer roller 144 and the intermediate transfer belt 143 is smaller at the respective supported portions 144*a* than at the center portion 144*b*. A primary transfer current applied to the primary transfer roller 144 at the primary transfer nip is greater at the respective supported portions 144*a* than at the center portion 144*b*.

If the primary transfer current is controlled under a constant current control, the primary transfer current may increase at lateral end primary transfer nips formed by the supported portions 144*a* of the primary transfer roller 144, respectively. Accordingly, an appropriate primary transfer current applied at the respective lateral end primary transfer nips formed by the supported portions 144*a* of the primary transfer roller 144 is smaller than a primary transfer current applied at a center primary transfer nip formed by the center portion 144*b* of the primary transfer roller 144. Consequently, a primary transfer rate achieved by the respective supported portions 144*a* of the primary transfer roller 144 is smaller than a primary transfer rate achieved by the center portion 144*b* of the primary transfer roller 144. In order to increase a toner density of the toner image adhered to a center portion of the intermediate transfer belt 143 in the main scanning direction, a primary transfer voltage applied to the primary transfer roller 144 is adjusted to increase the primary transfer current flowing through the primary transfer roller 144. As a result, since the primary transfer current readily flows through both lateral end portions of the intermediate transfer belt 143 that are disposed opposite the respective supported portions 144*a* of the primary transfer roller 144, toner of the toner image may be primarily transferred onto both lateral end portions of the intermediate transfer belt 143 excessively. Thus, deviation in the toner adhesion amount of toner adhered to the intermediate transfer belt 143 occurs in the main scanning direction of the intermediate transfer belt 143.

Figure 4A:
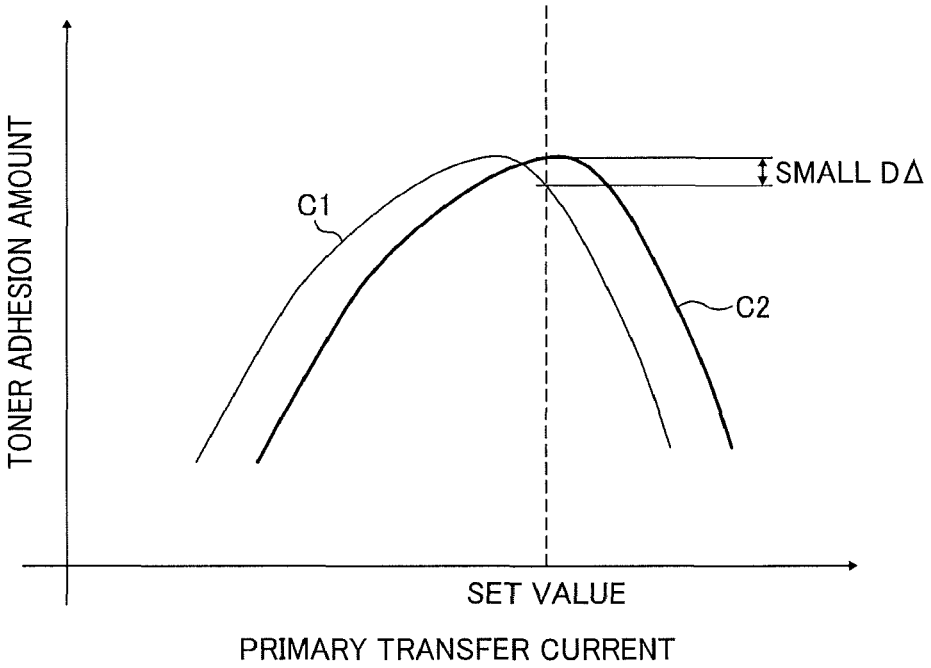
FIG. 4A is a graph illustrating a relation between a primary transfer current applied to the primary transfer roller depicted in FIG. 3 and a toner adhesion amount of toner adhered to an intermediate transfer belt incorporated in the image forming apparatus depicted in FIG. 1 with a relatively great toner charge amount.
Figure 4B:
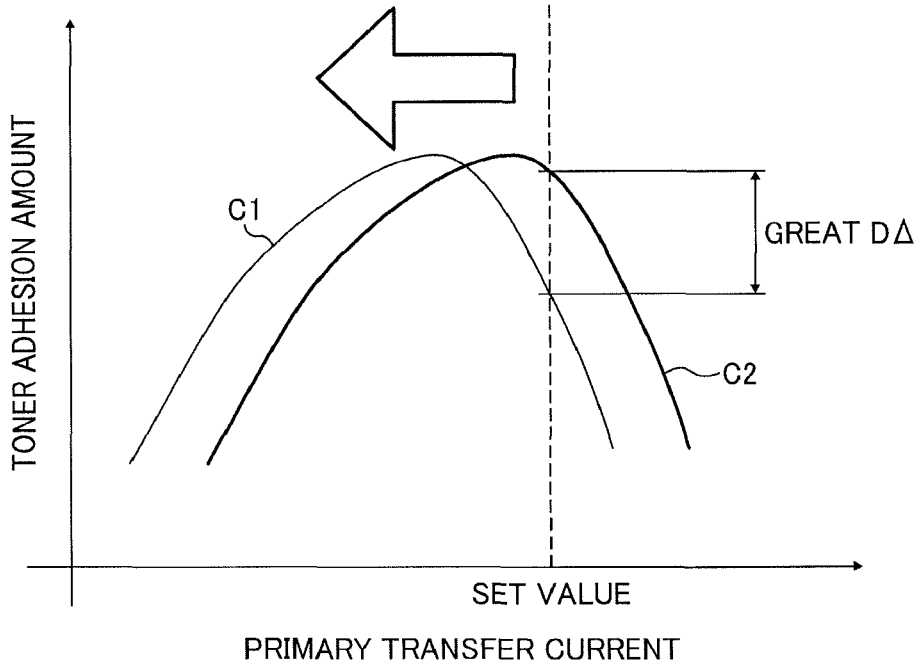
FIG. 4B is a graph illustrating a relation between the primary transfer current and the toner adhesion amount with a relatively small toner charge amount.

FIGS. 4A and 4B illustrate the toner adhesion amount of toner adhered to the intermediate transfer belt 143 that varies depending on a set value of the primary transfer current applied to the supported portions 144*a* and the center portion 144*b* of the primary transfer roller 144. In FIGS. 4A and 4B, a curve C1 represents the toner adhesion amount of toner adhered to the intermediate transfer belt 143, that is achieved by the respective supported portions 144*a* of the primary transfer roller 144. A curve C2 represents the toner adhesion amount of toner adhered to the intermediate transfer belt 143, which is achieved by the center portion 144*b* of the primary transfer roller 144. FIG. 4A is a graph illustrating the curves C1 and C2 achieved with a toner charge amount (q/m) of toner charged by the charger 123, that is relatively great. FIG. 4B is a graph illustrating the curves C1 and C2 achieved with a toner charge amount (q/n) of toner charged by the charger 123, that is relatively small. The toner charge amount of toner charged by the charger 123 is hereinafter referred to as the toner charge amount or the toner charge amount (q/m).

The contact area where the primary transfer roller 144 contacts the intermediate transfer belt 143 is greater at the respective supported portions 144*a* than at the center portion 144*b*. The contact resistance between the primary transfer roller 144 and the intermediate transfer belt 143 is smaller at the respective supported portions 144*a* than at the center portion 144*b*. Accordingly, the primary transfer current flowing through the lateral end primary transfer nip formed by the respective supported portions 144*a* of the primary transfer roller 144 is greater than the primary transfer current flowing through the center primary transfer nip formed by the center portion 144*b* of the primary transfer roller 144. Hence, a primary transfer profile that controls the primary transfer current according to the toner adhesion amount of toner adhered to the intermediate transfer belt 143 is different between the supported portions 144*a* and the center portion 144*b* of the primary transfer roller 144. In order to suppress variation in a toner density of the toner image, the primary transfer current is adjusted in view of quality of the toner image transferred onto the center portion of the intermediate transfer belt 143 in the main scanning direction. Accordingly, an appropriate primary transfer current is set based on the primary transfer profile of the center portion 144*b* of the primary transfer roller 144.

However, the appropriate primary transfer current set to the center portion 114*b* is excessively high for the respective supported portions 144*a* that press the intermediate transfer belt 143 against the photoconductive drum 122 with a first primary transfer nip pressure greater than a second primary transfer nip pressure with which the center portion 144*b* presses the intermediate transfer belt 143 against the photoconductive drum 122. Accordingly, toner of the toner image may be primarily transferred onto the lateral end portions of the intermediate transfer belt 143 excessively. In this case, as illustrated in FIG. 4A, under a condition in which toner degradation is relatively small and the toner charge amount is relatively great, the toner adhesion amount of toner adhered to the intermediate transfer belt 143 does not vary. Accordingly, the primary transfer profile barely varies between the supported portions 144*a* and the center portion 144*b*, suppressing variation in the toner density of the toner image.

Conversely, as illustrated in FIG. 4B, under a condition in which toner degradation progresses and the toner charge amount is relatively small, the primary transfer profile of the supported portions 144*a* and the center portion 144*b* shifts from the appropriate primary transfer current leftward in FIG. 4B to a lower value of the primary transfer current. In this case also, since the primary transfer current set before toner degrades is slightly smaller than the appropriate primary transfer current for the center portion 144*b*, even if toner degradation progresses and the appropriate primary transfer current for the center portion 144*b* decreases gradually, the primary transfer current set before toner degrades is slightly greater than the appropriate primary transfer current. That is, even if toner degradation progresses, the set value of the primary transfer current flowing through the center primary transfer nip formed by the center portion 144*b* is near the appropriate primary transfer current. Hence, the center portion 144*b* is immune from substantial decrease in the primary transfer rate.

Conversely, the primary transfer profile of the supported portions 144*a* shifts from the appropriate primary transfer current leftward in FIG. 4B to the lower value of the primary transfer current, accelerating excessive transfer of toner onto both lateral end portions of the intermediate transfer belt 143 in the main scanning direction. For example, since the set value of the primary transfer current set for the supported portions 144*a* before toner degrades is slightly greater than the appropriate primary transfer current, as toner degradation progresses and the appropriate primary transfer current decreases gradually, the set value of the primary transfer current set before toner degrades is even greater than the appropriate primary transfer current.

Accordingly, as toner degradation progresses, the supported portions 144*a* are more susceptible to excessive transfer of toner onto both lateral end portions of the intermediate transfer belt 143 in the main scanning direction, thus degrading the primary transfer rate substantially. Consequently, as toner degradation progresses, a difference in the primary transfer rate between the supported portions 144*a* and the center portion 144*b* increases, thus generating a deviation DA in the toner adhesion amount of toner adhered to the intermediate transfer belt 143 in the main scanning direction between the lateral end portions of the intermediate transfer belt 143 disposed opposite the supported portions 144*a*, respectively, and the center portion of the intermediate transfer belt 143 disposed opposite the center portion 144*b* (hereinafter referred to as the deviation DA in the toner adhesion amount in the main scanning direction). Since the deviation DA in the toner adhesion amount in the main scanning direction correlates to a toner degradation rate, the toner degradation rate is calculated by detecting the deviation DA in the toner adhesion amount in the main scanning direction.

Figure 5:
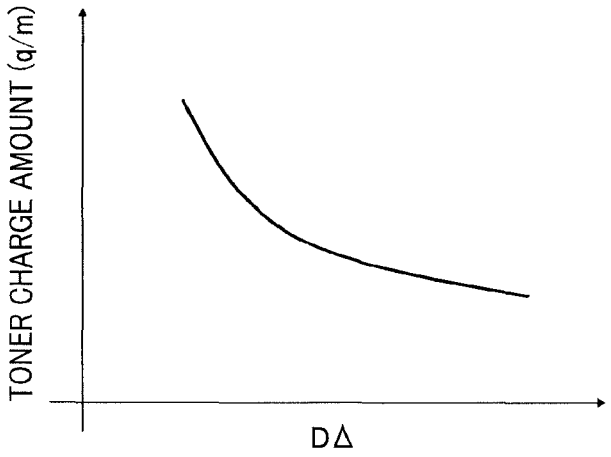
FIG. 5 is a graph illustrating a correlation between deviation in the toner adhesion amount and a toner degradation rate.

FIG. 5 is a graph illustrating a correlation between the deviation DA in the toner adhesion amount in the main scanning direction and the toner degradation rate. As illustrated in FIG. 5, as the toner charge amount decreases, the deviation DA in the toner adhesion amount in the main scanning direction increases between both lateral end portions of the intermediate transfer belt 143 that are disposed opposite the supported portions 144*a* and the center portion of the intermediate transfer belt 143 that is disposed opposite the center portion 144*b*. Conversely, as the toner charge amount increases, the deviation DA in the toner adhesion amount in the main scanning direction decreases between both lateral end portions of the intermediate transfer belt 143 that are disposed opposite the supported portions 144*a*, respectively, and the center portion of the intermediate transfer belt 143 that is disposed opposite the center portion 144*b*. The deviation DΔ in the toner adhesion amount in the main scanning direction has a certain correlation to the toner charge amount. Accordingly, the deviation DΔ in the toner adhesion amount in the main scanning direction is calculated to detect the toner charge amount so as to detect the toner degradation rate.

The toner adhesion amount of toner adhered to the intermediate transfer belt 143 may vary due to factors other than the primary transfer current, such as variation in charging of the photoconductive drum 122 in the main scanning direction by the charger 123 and variation in exposure of the photoconductive drum 122 in the main scanning direction by the exposure device 124. Accordingly, variation in the toner adhesion amount of toner adhered to a single toner pattern used to detect the toner degradation rate and formed on the intermediate transfer belt 143 may result from a factor other than toner degradation and therefore the detected toner degradation rate may not be precise. In order to allow the image forming apparatus 1 to perform a control that suppresses variation in the toner density of the toner image based on the toner degradation rate precisely, the toner degradation rate is requested to be detected precisely.

As a developing method to even a surface of a toner layer formed on the photoconductive drum 122, an alternating current voltage is superimposed on a direct current voltage to produce a superimposed bias. Under the developing method, an electrostatic force is exerted to toner of the toner layer in a developing direction in which a developing member (e.g., a developing roller) rotates and a rotation direction of the photoconductive drum 122. If the toner charge amount (q/m) decreases due to toner degradation and the electrostatic force decreases, the toner may not correspond to change in an electric field generated between the photoconductive drum 122 and the developing member. Accordingly, the toner may adhere to a part of the photoconductive drum 122 or the toner may adhere to the photoconductive drum 122 unevenly, generating a Halo or an uneven color on the toner image. The uneven color defines variation in the toner density of the toner image in a sub-scanning direction of the primary transfer roller 144. The uneven color is evaluated with an uneven color value as an evaluation index. The greater the uneven color value is, the greater the uneven color is. The Halo defines white spots on a halftone image, which are produced in proximity to a boundary between the halftone image and a solid image. The Halo is evaluated with a Halo value as an evaluation index. The greater the Halo value is, the greater an amount of the white spots is.

Figure 6:
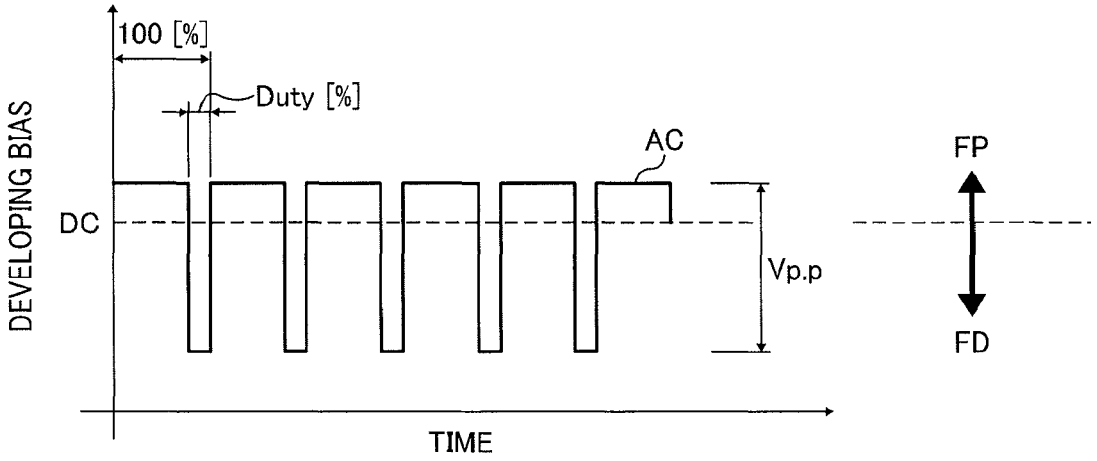
FIG. 6 is a graph illustrating a rectangular waveform of a superimposed bias in which an alternate current voltage is superimposed on a direct current voltage.

FIG. 6 is a graph illustrating a rectangular waveform of a superimposed bias, that is, a developing bias, in which an alternate current voltage is superimposed on a direct current voltage. FIG. 6 illustrates a control that suppresses the white spots and the uneven color on the toner image. For example, FIG. 6 illustrates the control that increases a duty cycle [%] according to the toner degradation rate. The duty cycle is defined as a rate of a pulse duration with respect to a period of a rectangular waveform of a superimposed bias voltage. Under the control depicted in FIG. 6, a return bias voltage to return toner from the photoconductive drum 122 is applied for an extended period of time to remove and return toner producing a projection from the uneven toner layer on the photoconductive drum 122 to a developing sleeve of the developing device 125, thus evening the toner layer on the photoconductive drum 122. FIG. 6 illustrates an electrostatic force FP exerted to the photoconductive drum 122 and an electrostatic force FD exerted to the developing sleeve as the return bias voltage.

Figure 7A:
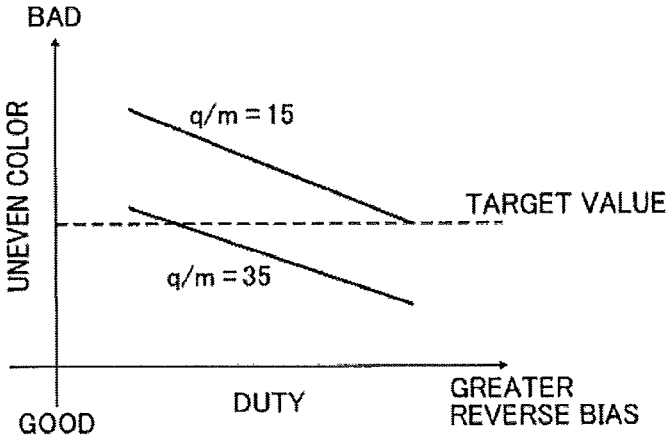
FIG. 7A is a graph illustrating a relation between a duty cycle of a superimposed bias voltage used in a developing device incorporated in the image forming apparatus depicted in FIG. 1 and an uneven color of a toner image.
Figure 7B:
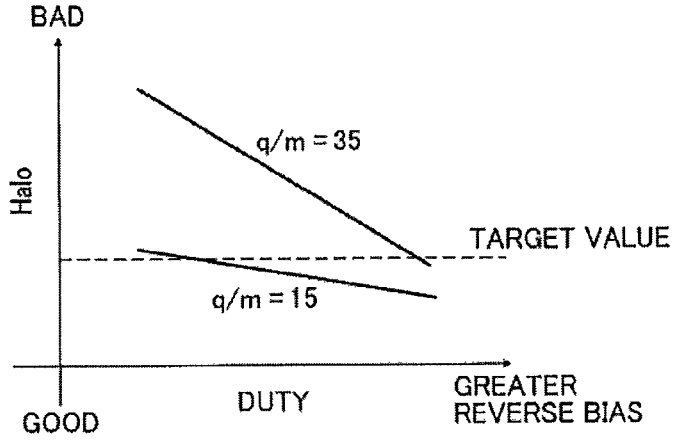
FIG. 7B is a graph illustrating a relation between the duty cycle of the superimposed bias voltage and a Halo value.

FIG. 7A is a graph illustrating a relation between the duty cycle of the superimposed bias voltage used in the developing device 125 and the uneven color. FIG. 7B is a graph illustrating a relation between the duty cycle of the superimposed bias voltage used in the developing device 125 and the Halo value. As illustrated in FIGS. 7A and 7B, if the duty cycle increases to return an increased amount of toner that causes the uneven color and the Halo, toner that produces the projection from the toner layer is removed from the photoconductive drum 122. Accordingly, the primary transfer current flows onto the entire toner layer forming the toner image evenly and the toner image adheres to the intermediate transfer belt 143 precisely, thus eliminating the uneven color and the Halo.

However, if the toner charge amount increases and the toner degradation rate is detected erroneously, even if toner adheres to the intermediate transfer belt 143 precisely and evenly, the duty cycle of the superimposed bias voltage may increase. As a result, toner returns from the photoconductive drum 122 to the developing member unnecessarily. Accordingly, the toner adhesion amount may be below a target amount and the toner density of the toner image may decrease. To address this circumstance, the toner degradation rate is requested to be detected precisely in the developing method using the superimposed bias voltage. In addition to the developing method using the superimposed bias voltage, the toner degradation rate is requested to be detected precisely also in a developing method using a direct current bias voltage to control a developing condition.

A description is provided of detection of the toner degradation rate performed by the image forming apparatus 1 in detail.

Figure 8:
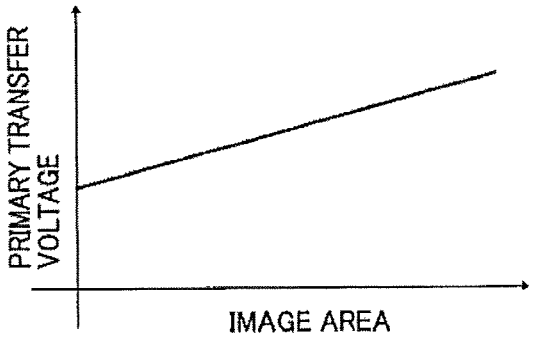
FIG. 8 is a graph illustrating a relation between an image area and a primary transfer voltage under a primary transfer control using a constant current.

FIG. 8 is a graph illustrating a relation between an image area and a primary transfer voltage under a primary transfer control using a constant current.

If the toner adhesion amount of toner adhered to the intermediate transfer belt 143 increases, an electric resistance at the primary transfer nip increases by an electric resistance of the toner image. The primary transfer current flowing through the primary transfer nip decreases. Since the primary transfer rate of toner has a close correlation to the primary transfer current, as the primary transfer current flowing through the primary transfer nip decreases, the primary transfer rate at the primary transfer nip decreases. Under the primary transfer control using the constant current, as the primary transfer current flowing through the primary transfer nip decreases, the primary transfer voltage applied to the primary transfer roller 144 increases so that the primary transfer current flowing through the primary transfer nip is substantially constant.

The primary transfer current flowing through the primary transfer nip is divided into a primary transfer current flowing through the center primary transfer nip disposed opposite the center portion 144*b* of the primary transfer roller 144 and a primary transfer current flowing through each of the lateral end primary transfer nips disposed opposite the supported portions 114*a*, respectively, of the primary transfer roller 144 according to a ratio between an electric resistance of the center primary transfer nip and an electric resistance of each of the lateral end primary transfer nips. Since the electric resistance of each of the lateral end primary transfer nips is smaller than the electric resistance of the center primary transfer nip, the primary transfer current flowing through each of the lateral end primary transfer nips is greater than the primary transfer current flowing through the center primary transfer nip.

If a toner pattern for detecting the toner degradation rate, that has a relatively great image area, adheres to the intermediate transfer belt 143, the toner adhesion amount of toner adhered to the intermediate transfer belt 143 is relatively great. Since the primary transfer roller 144 is supported at the supported portions 144*a*, the first primary transfer nip pressure exerted by the respective supported portions 144*a* of the primary transfer roller 144 to the intermediate transfer belt 143 is greater than the second primary transfer nip pressure exerted by the center portion 144*b* of the primary transfer roller 144 to the intermediate transfer belt 143 because the center portion 144*b* is bent slightly to decrease pressure exerted by the toner image adhered to the intermediate transfer belt 143 and thereby decrease the second primary transfer nip pressure. Accordingly, the electric resistance of the respective lateral end primary transfer nips is smaller than the electric resistance of the center primary transfer nip and a ratio between the electric resistance at the respective lateral end primary transfer nips and the electric resistance at the center primary transfer nip increases.

Although the primary transfer current flowing through the primary transfer nip is constant, the primary transfer current flows through the lateral end primary transfer nips more readily than the center primary transfer nip. Accordingly, the primary transfer current flowing through the respective lateral end primary transfer nips is greater than the primary transfer current flowing through the center primary transfer nip, facilitating excessive transfer of toner at the lateral end primary transfer nips. Even if the primary transfer current flowing through the primary transfer nip is constant, the primary transfer rate at the respective lateral end primary transfer nips is smaller than the primary transfer rate at the center primary transfer nip. Consequently, deviation in the toner adhesion amount in the main scanning direction may be different between a plurality of toner patterns for detecting the toner degradation rate, that has different image areas, respectively.

As toner degradation progresses and the toner charge amount decreases, the primary transfer rate decreases throughout the entire primary transfer nip and the toner adhesion amount of toner adhered to the intermediate transfer belt 143 decreases. Accordingly, a difference in the deviation DΔ in the toner adhesion amount in the main scanning direction between the plurality of toner patterns changes compared to the difference in the deviation DΔ before toner degradation progresses. To address this circumstance, the deviation DΔ in the toner adhesion amount in the main scanning direction is calculated for the toner patterns for detecting the toner degradation rate, that have the different image areas, respectively, to detect the toner degradation rate defining a progress of toner degradation.

One example of causes for the deviation DΔ in the toner adhesion amount in the main scanning direction that are other than toner degradation is variation in the toner charge amount in the main scanning direction and the sub-scanning direction. Even with variation in the toner charge amount, no difference appears in the deviation DΔ in the toner adhesion amount in the main scanning direction between the toner patterns for detecting the toner degradation rate, that have the different image areas, respectively. If the charger 123 is configured to charge the photoconductive drum 122 without contacting the photoconductive drum 122, a gap between a surface of a charging roller of the charger 123 and the outer circumferential surface of the photoconductive drum 122 suffers from variation in the toner charge amount in the main scanning direction as the outer circumferential surface of the photoconductive drum 122 deforms in the main scanning direction after electric discharge for an extended period of time.

If variation in the toner charge amount generates in the main scanning direction, even if the image area differs between the plurality of toner patterns or even if the toner adhesion amount of toner adhered to the intermediate transfer belt 143 decreases as toner degradation progresses and the absolute toner adhesion amount of toner adhered to the intermediate transfer belt 143 varies among a plurality of different positions on the intermediate transfer belt 143 in the main scanning direction, the deviation DΔ in the toner adhesion amount in the main scanning direction is unchanged. Even with variation in the toner charge amount in the main scanning direction, no difference appears in the deviation DΔ in the toner adhesion amount in the main scanning direction between the plurality of toner patterns for detecting the toner degradation rate, that has the different image areas, respectively.

On the other hand, variation in the toner charge amount in the sub-scanning direction occurs due to deformation of at least one of the charging roller of the charger 123 and the photoconductive drum 122 in a circumferential direction of the charging roller and the photoconductive drum 122 at the gap between the surface of the charging roller and the outer circumferential surface of the photoconductive drum 122. Even with variation in the toner charge amount in the sub-scanning direction, even if the image area differs between the plurality of toner patterns or even if the toner adhesion amount of toner adhered to the intermediate transfer belt 143 decreases as toner degradation progresses and the absolute toner adhesion amount of toner adhered to the intermediate transfer belt 143 varies among a plurality of different positions on the intermediate transfer belt 143 in the sub-scanning direction, the deviation DΔ in the toner adhesion amount in the main scanning direction is unchanged. Even with variation in the toner charge amount in the sub-scanning direction, no difference appears in the deviation DΔ in the toner adhesion amount in the main scanning direction between the plurality of toner patterns for detecting the toner degradation rate, that has the different image areas, respectively.

Another example of causes for the deviation DΔ in the toner adhesion amount in the main scanning direction that are other than toner degradation is variation in the exposure amount of the photoconductive drum 122 in the main scanning direction and the sub-scanning direction. Even with variation in the exposure amount, no difference appears in the deviation DΔ in the toner adhesion amount in the main scanning direction between the toner patterns for detecting the toner degradation rate, that have the different image areas, respectively.

If the exposure device 124 incorporates a plurality of light emitting elements aligned in the main scanning direction and configured to exposure the outer circumferential surface of the photoconductive drum 122, as the photoconductive drum 122 suffers from shortage of light emitted by the light emitting elements, the exposure amount of the photoconductive drum 122 varies in the main scanning direction. With variation in the exposure amount of the photoconductive drum 122 in the main scanning direction, if the image area differs between the plurality of toner patterns or if the toner adhesion amount of toner adhered to the intermediate transfer belt 143 decreases as toner degradation progresses, the deviation DΔ in the toner adhesion amount in the main scanning direction among the plurality of different positions on the intermediate transfer belt 143 in the main scanning direction is unchanged. Even with variation in the toner charge amount in the main scanning direction, no difference appears in the deviation DΔ in the toner adhesion amount in the main scanning direction between the plurality of toner patterns for detecting the toner degradation rate, that has the different image areas, respectively.

Conversely, the exposure amount of the photoconductive drum 122 in the sub-scanning direction is substantially constant and therefore variation in the exposure amount of the photoconductive drum 122 does not occur in the sub-scanning direction. Even with variation in the exposure amount of the photoconductive drum 122 in the sub-scanning direction, no difference appears in the deviation DΔ in the toner adhesion amount in the main scanning direction between the plurality of toner patterns for detecting the toner degradation rate, that has the different image areas, respectively. Accordingly, the difference in the deviation DΔ in the toner adhesion amount in the main scanning direction results from toner degradation, not variation in the toner charge amount, the exposure amount of the photoconductive drum 122, or the like in the main scanning direction and the sub-scanning direction.

Figure 9:
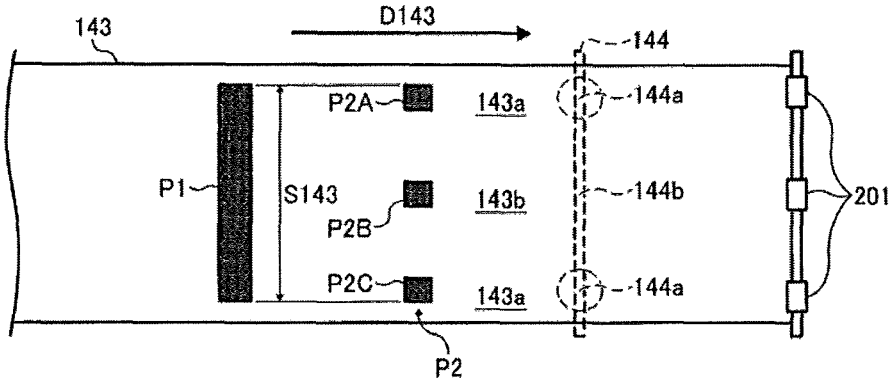
FIG. 9 is a plan view of the intermediate transfer belt, illustrating a first toner pattern and a second toner pattern formed thereon.

To address the circumstances described above, the photoconductive drum 122 is formed with a plurality of toner images that is primarily transferred onto the intermediate transfer belt 143 as a plurality of toner patterns, that is, a first toner pattern P1 and a second toner pattern P2 used for detecting the toner degradation rate as illustrated in FIG. 9. The first toner pattern P1 has a first image area and the second toner pattern P2 has a second image area different from the first image area. FIG. 9 is a plan view of the intermediate transfer belt 143, illustrating the first toner pattern P1 and the second toner pattern P2.

Referring to FIG. 9, a description is provided of a configuration to detect the toner adhesion amount of toner adhered to the intermediate transfer belt 143.

As illustrated in FIG. 9, a plurality of toner adhesion amount detecting sensors 201 serving as a toner adhesion amount detector is aligned in a direction (e.g., the main scanning direction) perpendicular to the rotation direction D143 of the intermediate transfer belt 143. The toner adhesion amount detecting sensors 201 are disposed opposite the outer circumferential surface of the intermediate transfer belt 143. For example, two toner adhesion amount detecting sensors 201 are disposed in proximity to the supported portions 144*a* of the primary transfer roller 144. One toner adhesion amount detecting sensor 201 is disposed in proximity to the center portion 144*b* of the primary transfer roller 144. As the intermediate transfer belt 143 rotates in the rotation direction D143, the toner adhesion amount detecting sensors 201 detect a toner adhesion amount of toner adhered to the first toner pattern P1 and the second toner pattern P2 formed on the intermediate transfer belt 143 at a plurality of positions on each of the first toner pattern P1 and the second toner pattern P2 in the main scanning direction.

Figure 10:
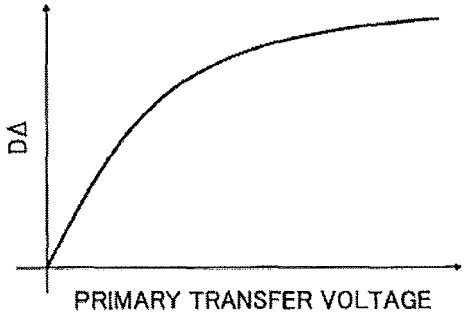
FIG. 10 is a graph illustrating a relation between a primary transfer voltage and the deviation in the toner adhesion amount.
Figure 11:
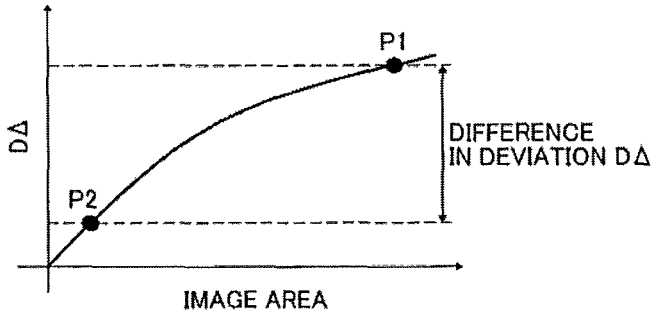
FIG. 11 is a graph illustrating a relation between an image area and the deviation in the toner adhesion amount.

FIG. 10 is a graph illustrating a relation between the primary transfer voltage and the deviation DΔ in the toner adhesion amount in the main scanning direction. FIG. 11 is a graph illustrating a relation between the image area and the deviation DΔ in the toner adhesion amount in the main scanning direction.

As illustrated in FIGS. 9 and 11, the controller 10 depicted in FIG. 2 calculates the toner degradation rate based on a difference between the deviation DΔ in the toner adhesion amount of toner adhered to the first toner pattern P1 having the first image area and the deviation DΔ in the toner adhesion amount of toner adhered to the second toner pattern P2 having the second image area smaller than the first image area. Based on the calculated toner degradation rate, the controller 10 determines a frequency, a duty cycle, and a difference between a maximum value and a minimum value of a superimposed bias voltage (Vpp), which define a developing condition using a superimposed bias described below. The controller 10 performs a developing process to develop an electrostatic latent image formed on the photoconductive drum 122 into a toner image based on the determined developing condition, thus suppressing variation in the toner density of the toner image.

A description is provided of a control according to a first exemplary embodiment performed by the controller 10.

Under the control according to the first exemplary embodiment, the controller 10 adjusts the duty cycle as a parameter of the developing condition using the superimposed bias.

Figure 12A:
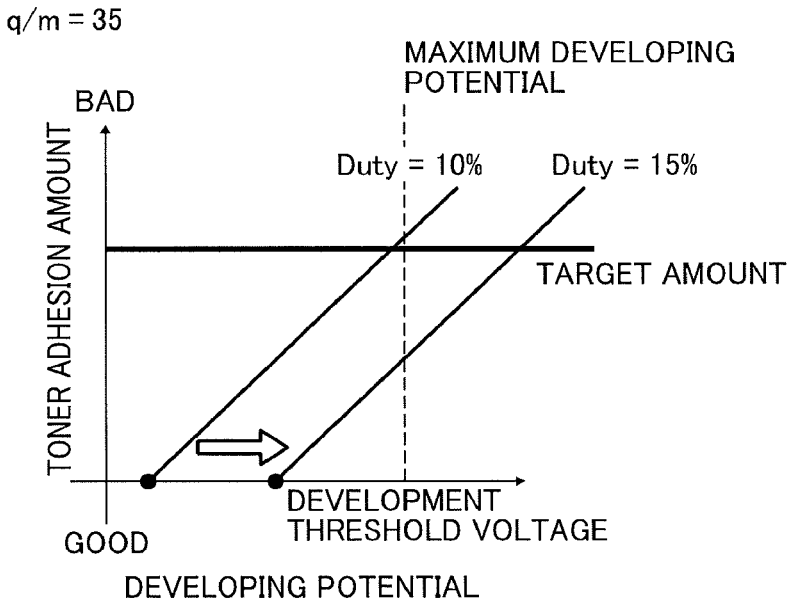
FIG. 12A is a graph illustrating a relation between a developing potential and the toner adhesion amount of toner adhered to the first toner pattern and the second toner pattern depicted in FIG. 9 with a relatively great toner charge amount and the duty cycle of 10 percent and 15 percent.

FIG. 12A is a graph illustrating a relation between a developing potential and the toner adhesion amount of toner adhered to the first toner pattern P1 and the second toner pattern P2 with a relatively great toner charge amount and the duty cycle of 10 percent and 15 percent. As illustrated in FIG. 12A, if the toner charge amount (q/m) is relatively great, under the greater duty cycle of 15 percent, a return bias increases. Accordingly, a development threshold voltage under the duty cycle of 15 percent is greater than a development threshold voltage under the duty cycle of 10 percent. Consequently, when the developing potential is maximum, an available developing potential decreases and a developing γ is unchanged, resulting in failure to attain a target toner adhesion amount.

Figure 12B:
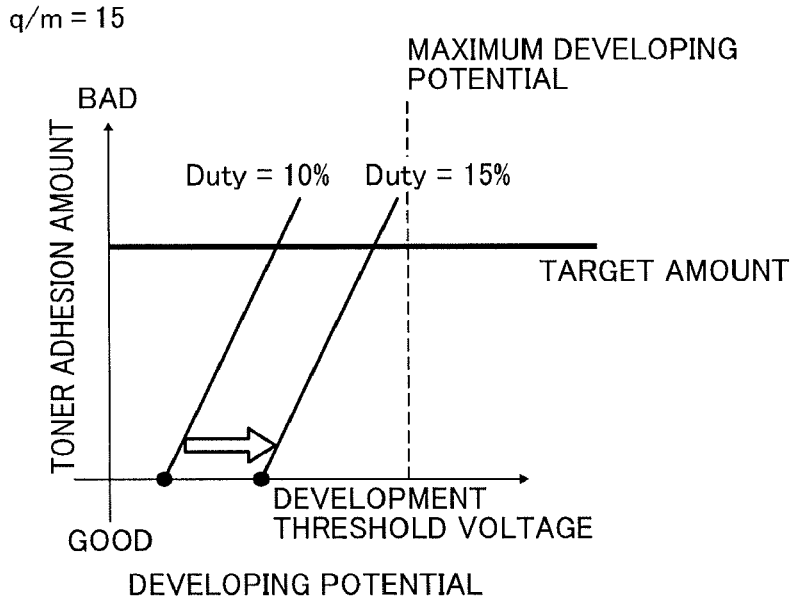
FIG. 12B is a graph illustrating a relation between the developing potential and the toner adhesion amount of toner adhered to the first toner pattern and the second toner pattern depicted in FIG. 9 with a relatively small toner charge amount and the duty cycle of 10 percent and 15 percent.

FIG. 12B is a graph illustrating a relation between the developing potential and the toner adhesion amount of toner adhered to the first toner pattern P1 and the second toner pattern P2 with a relatively small toner charge amount and the duty cycle of 10 percent and 15 percent. When the toner charge amount (q/m) is relatively small, the controller 10 increases the developing γ indicated by an inclination representing change in the toner adhesion amount relative to the developing potential. Accordingly, even if the development threshold voltage under the duty cycle of 15 percent is greater than the development threshold voltage under the duty cycle of 10 percent, the available developing potential is sufficient. Consequently, the target toner adhesion amount is attained sufficiently.

Even if the duty cycle as the developing condition using the superimposed bias increases in accordance with the relatively small toner charge amount (q/m) due to toner degradation, the target toner adhesion amount is attained and the toner density of the first toner pattern P1 and the second toner pattern P2 does not decrease, thus suppressing the side effect described above. The available developing potential defines an electric voltage obtained by subtracting the development threshold voltage from an upper limit of the developing potential. As a precondition, a lower limit of the target toner adhesion amount is attained at the available developing potential.

For example, if the toner charge amount (q/m) is smaller than a reference of 20, an effect of a return bias for the developing condition using the superimposed bias decreases compared to an effect of the return bias with the toner charge amount (q/m) being greater than the reference of 20, degrading prevention of the Halo and the uneven color on the toner image. To address this circumstance, according to the first exemplary embodiment, the controller 10 increases the duty cycle to increase the return bias. In this case, shortage of the developing potential may occur as a side effect. However, if the toner charge amount (q/m) is relatively small, the controller 10 increases the developing γ as described above. Hence, the developing potential increases sufficiently, allowing the duty cycle to be relatively great.

A description is provided of a control according to a second exemplary embodiment performed by the controller 10.

Under the control according to the second exemplary embodiment, the controller 10 adjusts the frequency and the duty cycle as a parameter of the developing condition using the superimposed bias.

FIG. 13 is a diagram illustrating change in the uneven color and the Halo and change in the developing γ and the available developing potential as side effects if the controller 10 increases each parameter of the developing condition according to the second exemplary embodiment. As illustrated in FIG. 13, as the frequency increases, a toner particle is susceptible to separation from a carrier particle, increasing the developing γ indicated by the inclination representing change in the toner adhesion amount relative to the developing potential. The available developing potential is obtained by subtracting the development threshold voltage from the upper limit of the developing potential. As the frequency increases, a developing capacity increases. Accordingly, the development threshold voltage decreases relatively and the available developing potential increases. As the controller 10 increases the duty cycle relatively, the development threshold voltage increases as described above and the available developing potential decreases.

When the developing device 125 forms a halftone image after forming a solid image, the Halo defines white spots on the halftone image produced in proximity to the boundary between the halftone image and the solid image due to an effect of developing scavenging. The greater the Halo is, the worse the Halo is. As the frequency increases, the developing capacity increases. Accordingly, the developing device 125 increases an amount of toner supplied to the photoconductive drum 122 at a developing nip formed between the developing device 125 and the photoconductive drum 122, thus decreasing the effect of developing scavenging and improving the Halo. As the duty cycle increases, the effect of the return bias increases, evening the toner adhesion amount and improving the Halo. The uneven color defines variation in the toner density of the toner image in the sub-scanning direction. The greater a value of the uneven color is, the worse the uneven color is. As the frequency increases, the developing capacity increases. Hence, deviation in the toner density is apparent in the developing process and the uneven color deteriorates. As the duty cycle increases, the effect of the return bias increases, evening the toner adhesion amount and improving the uneven color.

If the toner charge amount (q/m) is greater than the reference of 20, the Halo deteriorates as a major quality failure. As the toner charge amount (q/m) is greater than the reference of 20, developing scavenging is promoted. Conversely, if the toner charge amount (q/m) is greater than the reference of 20, the uneven color improves sufficiently relative to a target value. If the toner charge amount (q/m) is greater than the reference of 20, in order to increase the effect of the return bias, the controller 10 is requested to increase the duty cycle and improve the Halo. However, the Halo may not reach a target level. To address this circumstance, the controller 10 increases the frequency. Since the uneven color improves sufficiently, the controller 10 adjusts the deteriorating Halo. When the toner charge amount (q/m) is greater than the reference of 20, the controller 10 increases the frequency and the duty cycle compared to when the toner charge amount (q/m) is smaller than the reference of 20, thus improving the Halo.

A description is provided of processes for detecting the toner degradation rate and processes for determining the developing condition, which are performed by the controller 10.

Figure 14:
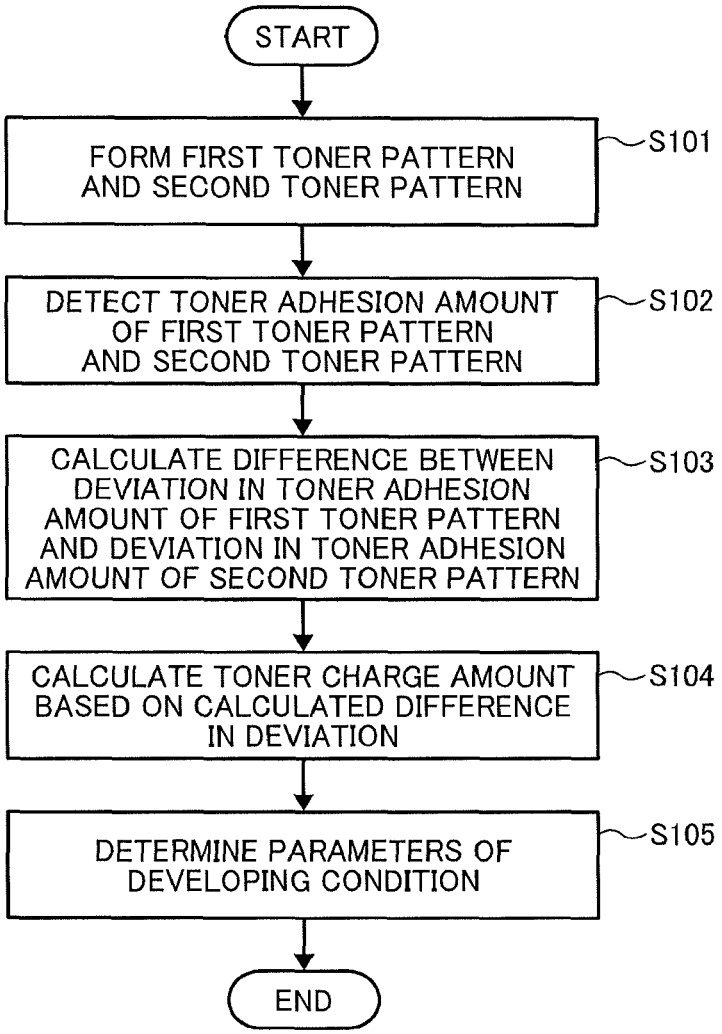
FIG. 14 is a flowchart illustrating processes for detecting the toner degradation rate and processes for determining the developing condition.

FIG. 14 is a flowchart illustrating the processes for detecting the toner degradation rate and the processes for determining the developing condition.

As illustrated in FIG. 14, in step S101, the first toner pattern P1 having the first image area, that is, a solid toner image, and the second toner pattern P2 having the second image area smaller than the first image area are formed on the intermediate transfer belt 143. The first toner pattern P1 and the second toner pattern P2 are used to detect the toner degradation rate.

In step S102, the toner adhesion amount detecting sensors 201 depicted in FIG. 9 detect the toner adhesion amount of toner adhered to the first toner pattern P1 and the second toner pattern P2 formed on the intermediate transfer belt 143 at the plurality of positions aligned on each of the first toner pattern P1 and the second toner pattern P2 in the main scanning direction perpendicular to the rotation direction D143 of the intermediate transfer belt 143.

In step S103, the controller 10 calculates the difference between the deviation DΔ in the toner adhesion amount of toner adhered to the first toner pattern P1 and the deviation DΔ in the toner adhesion amount of toner adhered to the second toner pattern P2 in the main scanning direction.

In step S104, the controller 10 calculates the toner charge amount, that is, the toner degradation rate, based on the calculated difference.

In step S105, based on the calculated toner charge amount, the controller 10 determines the frequency, the duty cycle, and the Vpp, that is, the difference between the maximum value and the minimum value of the superimposed bias voltage, which are parameters defining the developing condition using the superimposed bias.

The controller 10 performs the developing process based on the determined developing condition, thus improving the uneven color and the Halo.

A description is provided of a control according to a third exemplary embodiment performed by the controller 10.

Under the control according to the third exemplary embodiment, the controller 10 adjusts a set value of the primary transfer current as a primary transfer condition based on the calculated toner degradation rate.

Figure 15A:
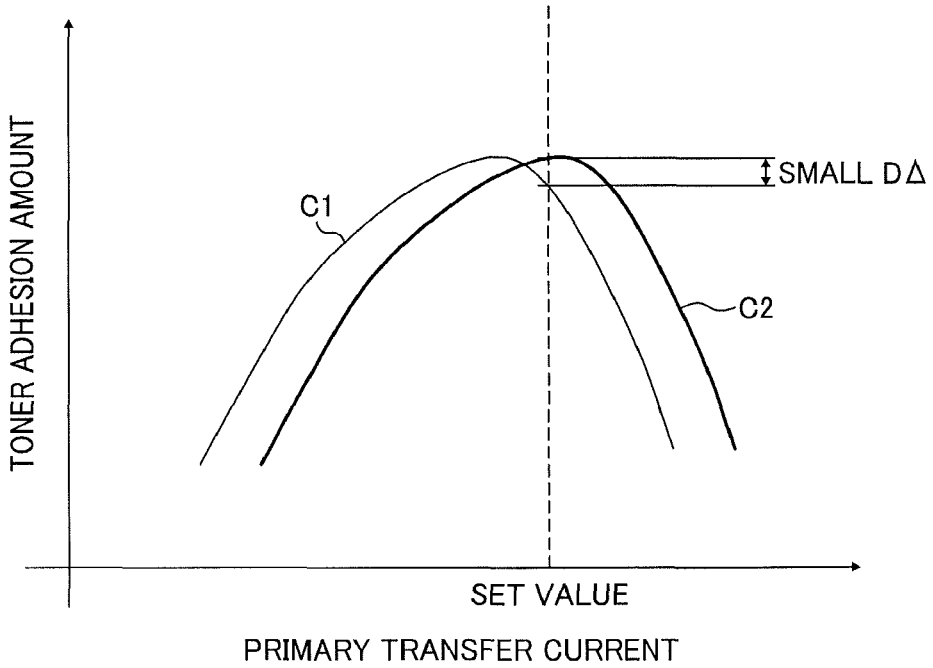
FIG. 15A is a graph illustrating a relation between the primary transfer current and the toner adhesion amount with a relatively great toner charge amount.
Figure 15B:
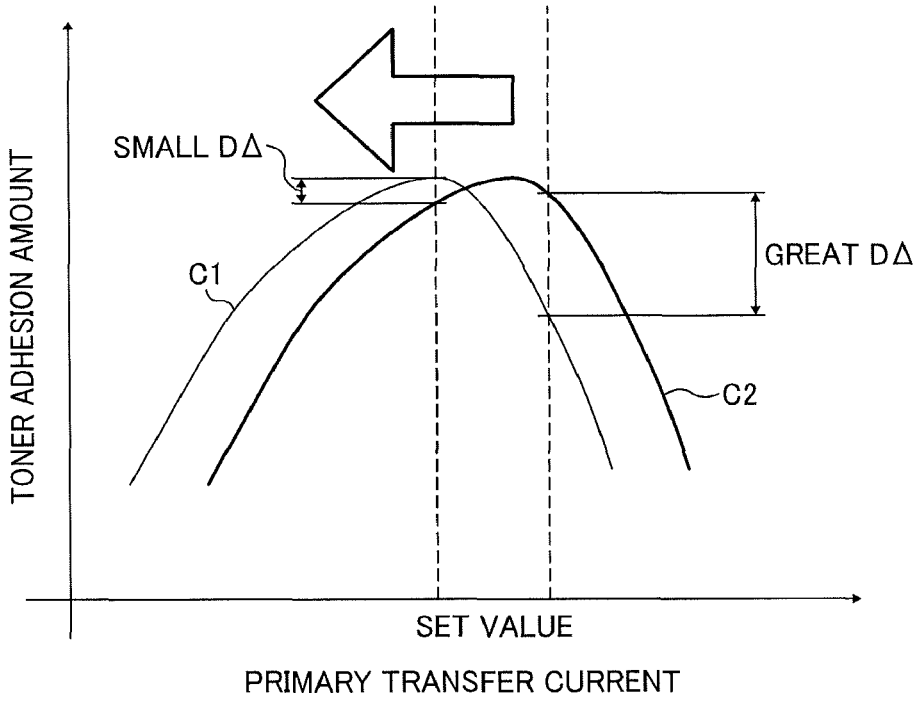
FIG. 15B is a graph illustrating a relation between the primary transfer current and the toner adhesion amount with a relatively small toner charge amount.

FIG. 15A is a graph illustrating a relation between the set value of the primary transfer current and the toner adhesion amount. FIG. 15A illustrates change in the toner adhesion amount relative to the set value of the primary transfer current at the supported portions 144*a* and the center portion 144*b* of the primary transfer roller 144 in a case in which the toner charge amount (q/m) is relatively great. FIG. 15B is a graph illustrating a relation between the set value of the primary transfer current and the toner adhesion amount. FIG. 15B illustrates change in the toner adhesion amount relative to the set value of the primary transfer current at the supported portions 144*a* and the center portion 144*b* of the primary transfer roller 144 in a case in which the toner charge amount (q/m) is relatively small.

Since the primary transfer roller 144 is supported at the supported portions 144*a* disposed at both lateral ends of the primary transfer roller 144 in the axial direction thereof, primary transfer nip pressure exerted by the respective supported portions 144*a* of the primary transfer roller 144 to the intermediate transfer belt 143 is greater than primary transfer nip pressure exerted by the center portion 144*b* of the primary transfer roller 144 to the intermediate transfer belt 143. The supported portions 144*a* press the intermediate transfer belt 143 against the photoconductive drum 122 at the lateral end primary transfer nips more closely than the center portion 114*b* does at the center primary transfer nip. A lateral end contact area where the intermediate transfer belt 143 contacts the photoconductive drum 122 at each of the lateral end primary transfer nips is greater than a center contact area where the intermediate transfer belt 143 contacts the photoconductive drum 122 at the center primary transfer nip.

Accordingly, the electric resistance of each of the lateral end primary transfer nips is smaller than the electric resistance of the center primary transfer nip. Consequently, the primary transfer current flowing through the primary transfer nip is divided into the primary transfer current flowing through the center primary transfer nip and the primary transfer current flowing through the respective lateral end primary transfer nips according to the ratio between the electric resistance of the center primary transfer nip and the electric resistance of the respective lateral end primary transfer nips. Since the primary transfer current flowing through the respective lateral end primary transfer nips is greater than the primary transfer current flowing through the center primary transfer nip, the respective lateral end primary transfer nips may suffer from excessive transfer of toner compared to the center primary transfer nip.

The set value of the primary transfer current flowing through the primary transfer nip is slightly smaller than an appropriate primary transfer current flowing through the center primary transfer nip and near an appropriate primary transfer current flowing through the respective lateral end primary transfer nips, thus decreasing excessive transfer of toner at the lateral end primary transfer nips. Accordingly, a primary transfer rate at the respective lateral end primary transfer nips is slightly smaller than a primary transfer rate at the center primary transfer nip, suppressing variation in the toner density of the toner image in the main scanning direction. However, as toner degradation progresses and the toner charge amount decreases, the appropriate primary transfer currents flowing through the center primary transfer nip and the lateral end primary transfer nips, respectively, tend to decrease. Since the set value of the primary transfer current set before toner degradation progresses is slightly smaller than the appropriate primary transfer current flowing through the center primary transfer nip, even if toner degradation progresses and the appropriate primary transfer current flowing through the center primary transfer nip decreases gradually, the set value of the primary transfer current is slightly greater than the appropriate primary transfer current. Even if toner degradation progresses, the set value of the primary transfer current applied to the primary transfer nip formed by the primary transfer roller 144 is near the appropriate primary transfer current at the center portion 144*b* of the primary transfer roller 144. Hence, the center portion 144*b* is immune from substantial decrease in the primary transfer rate.

Conversely, since the set value of the primary transfer current set for the supported portions 144*a* before toner degradation progresses is slightly greater than the appropriate primary transfer current, as toner degradation progresses and the appropriate primary transfer current decreases gradually, the set value of the primary transfer current set before toner degradation progresses is even greater than the appropriate primary transfer current. Accordingly, as toner degradation progresses, the supported portions 144*a* are more susceptible to excessive transfer of toner onto both lateral end portions 143*a* depicted in FIG. 9, respectively, of the intermediate transfer belt 143 in the main scanning direction, thus degrading the primary transfer rate substantially. Consequently, as toner degradation progresses, a difference in the primary transfer rate increases between both lateral end portions 143*a* of the intermediate transfer belt 143 that are disposed opposite the supported portions 144*a*, respectively, and a center portion 143*b* of the intermediate transfer belt 143 that is disposed opposite the center portion 144*b*, thus generating variation in the toner density of the toner image in the main scanning direction.

When the toner charge amount (q/m) is relatively great, as illustrated in FIG. 15A, even if the set value of the primary transfer current increases, an effect of excessive transfer of toner is small. Accordingly, if the toner charge amount (q/m) is relatively great, the controller 10 increases the set value of the primary transfer current flowing through the primary transfer nip formed by the primary transfer roller 144. Consequently, the primary transfer rate at the primary transfer nip formed by the primary transfer roller 144, which has the close correlation to the primary transfer current, increases.

Conversely, if the toner charge amount (q/m) is relatively small, as illustrated in FIG. 15B, the primary transfer current flowing through the primary transfer nip is small. Accordingly, the primary transfer current flowing through the lateral end primary transfer nips increases, facilitating excessive transfer of toner at the lateral end primary transfer nips. Consequently, the deviation DΔ in the toner adhesion amount of toner adhered to the intermediate transfer belt 143 in the main scanning direction increases. When the toner charge amount (q/m) is relatively small, the controller 10 decreases the set value of the primary transfer current flowing through the primary transfer nip formed by the primary transfer roller 144 to suppress excessive transfer of toner at the lateral end primary transfer nips.

Under the control according to the third exemplary embodiment, if the toner charge amount (q/m) is great than a reference value determined with an initial developer at an ambient temperature, the controller 10 adjusts the set value of the primary transfer current to be relatively great. Conversely, if the toner charge amount (q/m) is relatively small, the controller 10 adjusts the set value of the primary transfer current to be relatively small. Thus, the controller 10 reduces excessive transfer of toner and decreases variation in the toner density of the toner image in the main scanning direction.

Figure 16:
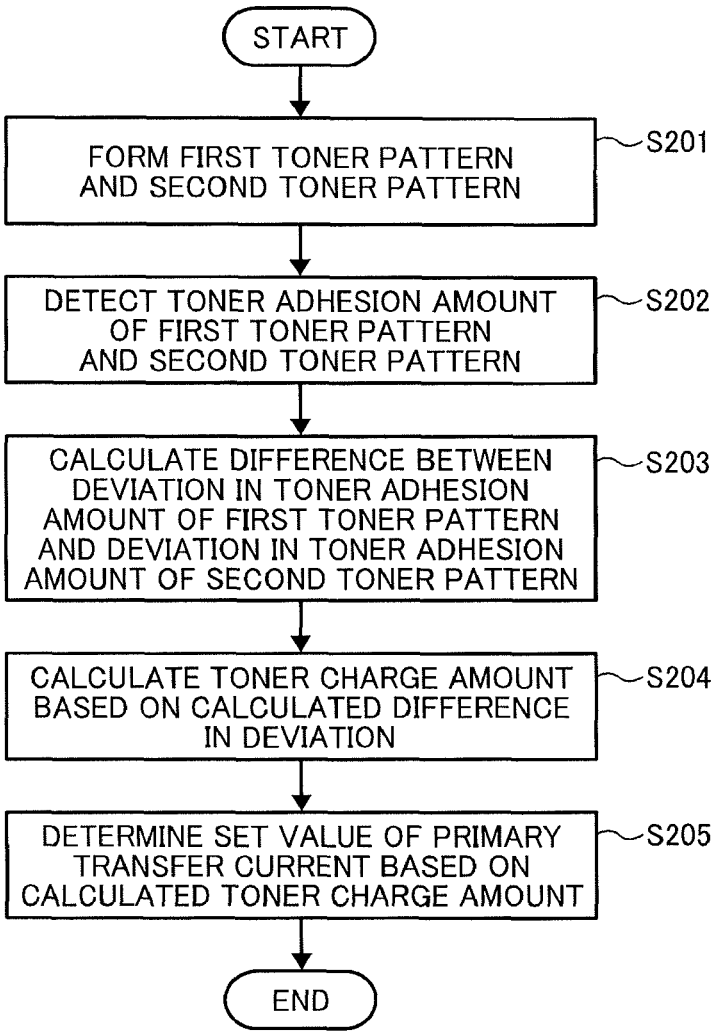
FIG. 16 is a flowchart illustrating processes for determining a set value of the primary transfer current based on the toner degradation rate detected by the processes for detecting the toner degradation rate.

FIG. 16 is a flowchart illustrating processes for determining the set value of the primary transfer current according to the toner degradation rate detected by the processes for detecting the toner degradation rate.

As illustrated in FIG. 16, in step S201, the first toner pattern P1 having the first image area, that is, the solid toner image, and the second toner pattern P2 having the second image area smaller than the first image area are formed on the intermediate transfer belt 143. The first toner pattern P and the second toner pattern P2 are used to detect the toner degradation rate.

In step S202, the toner adhesion amount detecting sensors 201 depicted in FIG. 9 detect the toner adhesion amount of toner adhered to the first toner pattern P1 and the second toner pattern P2 formed on the intermediate transfer belt 143 at the plurality of positions aligned on each of the first toner pattern P1 and the second toner pattern P2 in the main scanning direction.

In step S203, the controller 10 calculates the difference between the deviation DΔ in the toner adhesion amount of toner adhered to the first toner pattern P1 and the deviation DΔ in the toner adhesion amount of toner adhered to the second toner pattern P2 in the main scanning direction.

In step S204, the controller 10 calculates the toner charge amount, that is, the toner degradation rate, based on the calculated difference.

In step S205, based on the calculated toner charge amount (q/m), the controller 10 determines the set value of the primary transfer current as a primary transfer condition of the primary transfer roller 144.

The controller 10 supplies the primary transfer current having the determined set value to the primary transfer nip formed by the primary transfer roller 144. For example, if the calculated toner charge amount (q/m) is relatively great, the controller 10 increases the set value of the primary transfer current flowing through the primary transfer nip formed by the primary transfer roller 144. Thus, the controller 10 increases the primary transfer rate at the primary transfer nip formed by the primary transfer roller 144, which has the close correlation to the primary transfer current. Conversely, if the calculated toner charge amount (q/m) is relatively small, the controller 10 decreases the set value of the primary transfer current flowing through the primary transfer nip formed by the primary transfer roller 144. Thus, the controller 10 reduces excessive transfer of toner and decreases variation in the toner density of the toner image in the main scanning direction.

A description is provided of a control according to a fourth exemplary embodiment performed by the controller 10.

Under the control according to the fourth exemplary embodiment, the controller 10 adjusts a background potential based on the calculated toner degradation rate.

Figure 17A:
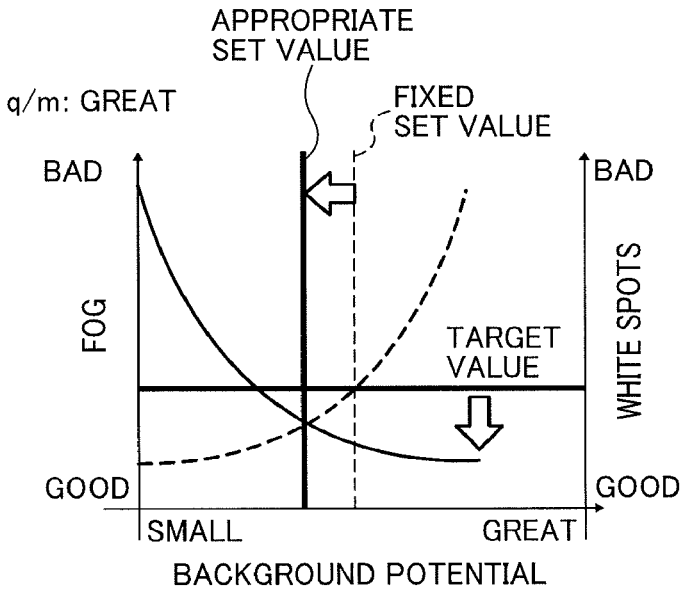
FIG. 17A is a graph illustrating a relation between a background potential and a fog with a relatively great toner charge amount.
Figure 17B:
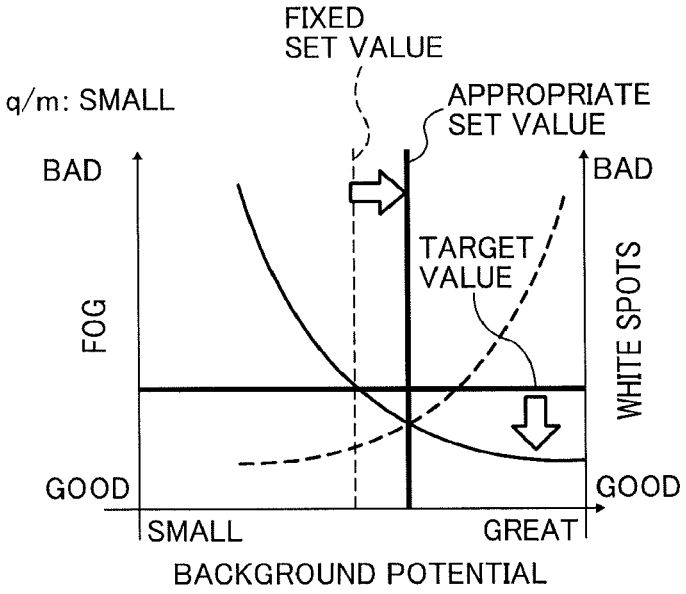
FIG. 17B is a graph illustrating a relation between the background potential and the fog with a relatively small toner charge amount.

FIG. 17A is a graph illustrating a relation between the background potential and a fog (e.g., background stains). FIG. 17A illustrates change in the fog and change in white spots on a halftone image relative to a set value of the background potential in a case in which the toner charge amount (q/m) is relatively great. FIG. 17B is a graph illustrating a relation between the background potential and the fog. FIG. 17B illustrates change in the fog and change in the white spots on the halftone image relative to the set value of the background potential in a case in which the toner charge amount (q/m) is relatively small.

The background potential defines a potential difference between a surface potential of a background portion of the photoconductive drum 122 and a developing bias applied to a developing bearer (e.g., a developing roller) of the developing device 125. As the background potential increases, the increased background potential reduces the fog and increases the white spots produced by carrier particles adhered to the halftone image. The white spots appear as small white blanks on the toner image. Alternatively, a faulty toner image suffering from the fog or the white spots may be formed due to increase and decrease of the toner charge amount (q/m).

When the toner charge amount (q/m) is relatively great, a leeway to be immune from the fog increases while a leeway to be immune from the white spots on the halftone image decreases. For example, when the developing device 125 develops an electrostatic latent image into a halftone image, as an edge effect is applied to the halftone image, an electric field of an edge portion of the halftone image is greater than an electric field of a line portion inboard from the edge portion. When the toner charge amount (q/m) increases, an amount of carrier particles adhered to the edge portion increases, producing a substantial amount of the white spots on the halftone image. The edge effect on the halftone image is aimed to accentuate the edge portion sharply. For example, the edge effect increases a counter charge (e.g., a charge having a polarity opposite a polarity of charged toner) of the carrier particles in the developing process to increase the electric field of the edge portion relative to the electric field of the line portion disposed inboard from the edge portion. Conversely, if the toner charge amount (q/m) is relatively small, the leeway to be immune from the white spots on the halftone image increases while the leeway to be immune from the fog decreases because toner is susceptible to adhesion to the background portion of the photoconductive drum 122 and deteriorates the fog.

To address this circumstance, as illustrated in FIG. 17A, if the toner charge amount (q/m) is relatively great, the leeway to be immune from the fog increases. Hence, the controller 10 decreases the background potential to a value smaller than a reference value determined with the initial developer at the ambient temperature to attain the leeway to be immune from the white spots on the halftone image. Conversely, as illustrated in FIG. 17B, if the toner charge amount (q/m) is relatively small, the leeway to be immune from the white spots on the halftone image increases. Hence, the controller 10 increases the background potential relatively to attain the leeway to be immune from the fog. For example, the controller 10 adjusts the background potential for each of cyan, magenta, yellow, and black toners as below. The controller 10 calculates the difference between the deviation DΔ in the toner adhesion amount of toner adhered to the first toner pattern P1 and the deviation DΔ in the toner adhesion amount of toner adhered to the second toner pattern P2 in the main scanning direction. The controller 10 calculates the toner charge amount (q/m) based on the calculated difference.

If the calculated toner charge amount (q/m) is greater than the reference value determined with the initial developer at the ambient temperature, the controller 10 relatively decreases a charging potential (e.g., a charging bias) of the photoconductive drum 122 uniformly charged by the charger 123, thus decreasing the background potential relative to a set value (e.g., a fixed, preset value). Accordingly, the controller 10 suppresses adhesion of the carrier particles to the edge portion due to the edge effect on the halftone image and generation of the white spots on the halftone image. Since the developer bearer of the developing device 125 picks up a developer containing toner particles and carrier particles in a relatively small amount, even if the controller 10 decreases the background potential relatively, the fog barely appears. Since the leeway to be immune from the fog is relatively great, the controller 10 suppresses adhesion of the carrier particles to the edge portion due to the edge effect on the halftone image and generation of the white spots on the halftone image, thus attaining the leeway to be immune from the white spots on the halftone image.

Conversely, if the calculated toner charge amount (q/m) is relatively small, the controller 10 relatively increases the charging potential of the photoconductive drum 122 uniformly charged by the charger 123, thus increasing the background potential relative to the set value and thereby suppressing the fog. Since the developer bearer of the developing device 125 picks up the developer in a relatively great amount, even if the controller 10 increases the background potential relatively, the white spots on the halftone image barely appear because the carrier particles barely adhere to the edge portion due to the edge effect on the halftone image. Since the leeway to be immune from the white spots on the halftone image is relatively great, the controller 10 suppresses the fog, thus attaining the leeway to be immune from the fog.

The control according to the fourth exemplary embodiment is described above with an example to adjust the background potential by changing the charging potential (e.g., the charging bias) of the photoconductive drum 122 uniformly charged. Alternatively, the background potential may be adjusted by changing the developing bias. The controller 10 may decrease the developing bias to increase the background potential and may increase the developing bias to decrease the background potential.

Figure 18:
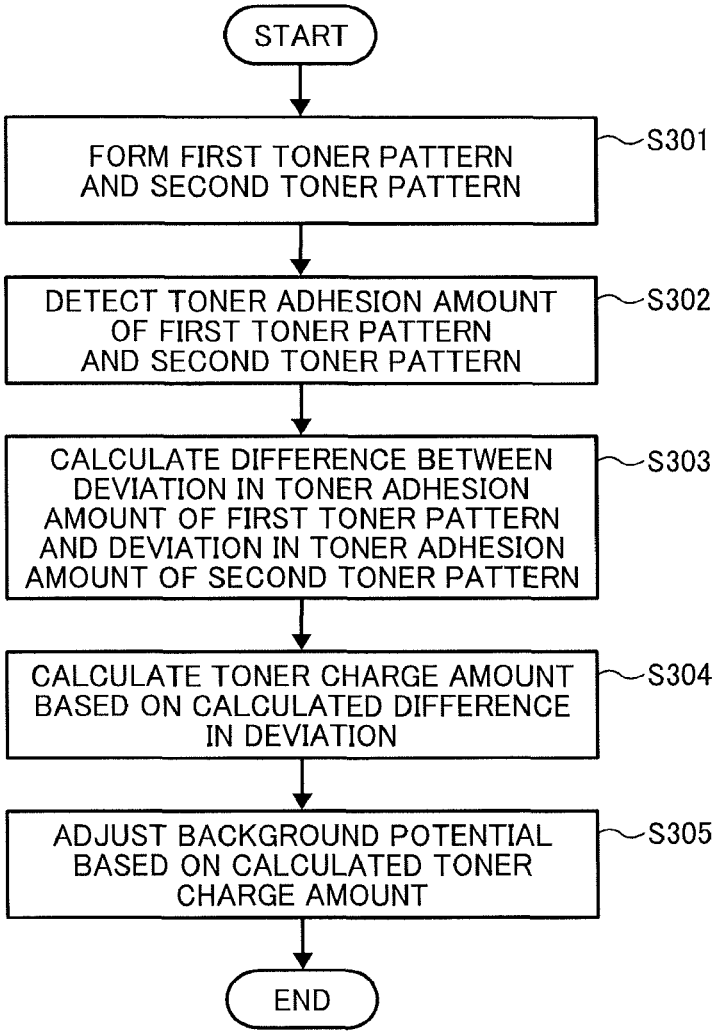
FIG. 18 is a flowchart illustrating processes for adjusting the background potential based on the toner degradation rate detected by the processes for detecting the toner degradation rate.

FIG. 18 is a flowchart illustrating processes for adjusting the background potential based on the toner degradation rate detected by the processes for detecting the toner degradation rate.

As illustrated in FIG. 18, in step S301, the first toner pattern P1 having the first image area, that is, the solid toner image, and the second toner pattern P2 having the second image area smaller than the first image area are formed on the intermediate transfer belt 143. The first toner pattern P1 and the second toner pattern P2 are used to detect the toner degradation rate.

In step S302, the toner adhesion amount detecting sensors 201 depicted in FIG. 9 detect the toner adhesion amount of toner adhered to the first toner pattern P1 and the second toner pattern P2 formed on the intermediate transfer belt 143 at the plurality of positions aligned on each of the first toner pattern P1 and the second toner pattern P2 in the main scanning direction.

In step S303, the controller 10 calculates the difference between the deviation DΔ in the toner adhesion amount of toner adhered to the first toner pattern P1 and the deviation DΔ in the toner adhesion amount of toner adhered to the second toner pattern P2 in the main scanning direction.

In step S304, the controller 10 calculates the toner charge amount, that is, the toner degradation rate, based on the calculated difference.

In step S305, based on the calculated toner charge amount (q/m), the controller 10 changes the charging bias and the developing bias to adjust the background potential.

For example, if the toner degradation rate is smaller than a reference value calculated with the initial developer at the ambient temperature and the toner charge amount (q/m) is greater than the reference value determined with the initial developer at the ambient temperature, the leeway to be immune from the fog increases. Hence, the controller 10 decreases the charging bias to a value smaller than a reference value determined with the initial developer at the ambient temperature and the background potential to a value smaller than a reference value determined with the initial developer at the ambient temperature to attain the leeway to be immune from the white spots on the halftone image. Conversely, if the toner degradation rate is relatively great and the toner charge amount (q/m) is relatively small, the leeway to be immune from the white spots on the halftone image increases. Hence, the controller 10 increases the charging bias and the background potential relatively to attain the leeway to be immune from the fog.

The controller 10 adjusts the developing condition and the primary transfer condition based on the detected toner degradation rate as described above. Alternatively, the controller 10 may perform a feedback to a charging condition and an exposure condition according to a type of a failure caused by toner degradation so as to eliminate the failure.

The exemplary embodiments described above are one example and attain advantages below in a plurality of aspects A to L.

A description is provided of advantages of the image forming apparatus 1 in an aspect A.

As illustrated in FIGS. 1 and 9, the image forming apparatus 1 includes an image bearer (e.g., the photoconductive drum 122), a toner image forming device (e.g., the developing device 125), a toner pattern bearer (e.g., the intermediate transfer belt 143), a transferor (e.g., the primary transfer roller 144), and a toner adhesion amount detector (e.g., the toner adhesion amount detecting sensor 201).

The image bearer bears a first electrostatic latent image and a second electrostatic latent image. The toner image forming device develops the first electrostatic latent image and the second electrostatic latent image formed on the image bearer into a first toner image and a second toner image, respectively. The toner pattern bearer is disposed opposite the image bearer and rotatable in a rotation direction (e.g., the rotation direction D143). The transferor transfers the first toner image and the second toner image formed on the image bearer onto the toner pattern bearer. The toner adhesion amount detector is disposed opposite the toner pattern bearer. The toner adhesion amount detector detects a toner adhesion amount of toner of the first toner image and the second toner image transferred onto and adhered to the toner pattern bearer.

Figure 19:
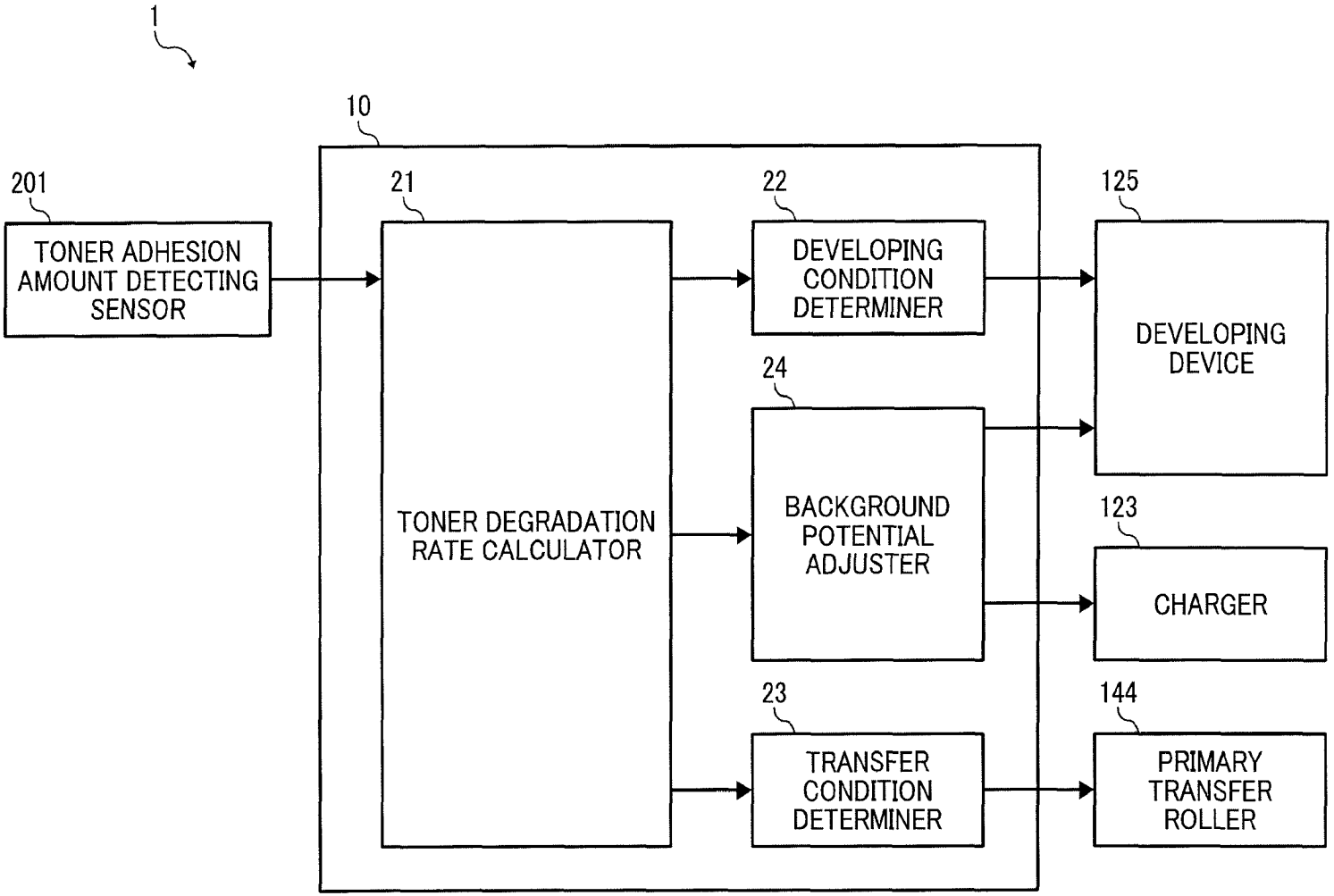
FIG. 19 is a block diagram of the image forming apparatus depicted in FIG. 1.

FIG. 19 is a block diagram of the image forming apparatus 1. As illustrated in FIG. 19, the controller 10 includes a toner degradation rate calculator 21 serving as a toner degradation rate calculator. The toner degradation rate calculator is connected to the toner adhesion amount detector (e.g., the toner adhesion amount detecting sensor 201). The toner degradation rate calculator calculates a toner degradation rate based on the toner adhesion amount detected by the toner adhesion amount detector. The toner degradation rate calculator causes the toner image forming device to form the first toner image and the second toner image on the image bearer so that the transferor transfers the first toner image and the second toner image as a plurality of toner patterns that is disposed at different positions on the toner pattern bearer in the rotation direction of the toner pattern bearer and has different image areas, respectively. That is, the transferor transfers the first toner image onto a first position on the toner pattern bearer as a first toner pattern (e.g., the first toner pattern P1) having a first image area and transfers the second toner image onto a second position on the toner pattern bearer as a second toner pattern (e.g., the second toner pattern P2) having a second image area different from the first image area. The second position is spaced apart from the first position in the rotation direction of the toner pattern bearer. The first toner pattern and the second toner pattern are used for detecting the toner degradation rate as illustrated in FIG. 9.

The toner degradation rate calculator causes the toner adhesion amount detector to detect the toner adhesion amount of toner adhered to each of the first toner pattern and the second toner pattern at a plurality of different positions aligned in a direction perpendicular to the rotation direction of the toner pattern bearer. The toner degradation rate calculator calculates a first deviation (e.g., the deviation DA) in the toner adhesion amount of the first toner pattern and a second deviation (e.g., the deviation DA) in the toner adhesion amount of the second toner pattern based on the toner adhesion amount detected at the plurality of different positions on the toner pattern bearer. The toner degradation rate calculator compares the calculated first deviation in the toner adhesion amount of the first toner pattern with the calculated second deviation in the toner adhesion amount of the second toner pattern. The toner degradation rate calculator calculates the toner degradation rate based on a comparison result.

With a configuration in which a toner image formed on the image bearer is transferred onto the toner pattern bearer such as an intermediate transferor and a recording medium conveyor, the transferor presses the toner pattern bearer against the image bearer to form a transfer nip between the toner pattern bearer and the image bearer with transfer nip pressure that varies in the direction (e.g., the main scanning direction) perpendicular to the rotation direction (e.g., the sub-scanning direction) of the toner pattern bearer.

For example, the transferor includes a transfer roller supported at supported portions (e.g., the supported portions 144*a*) of the transfer roller that are disposed at both lateral ends of the transfer roller in an axial direction thereof. Transfer nip pressure exerted by the respective supported portions of the transfer roller to the toner pattern bearer at respective lateral end transfer nips is greater than transfer nip pressure exerted by a center portion (e.g., the center portion 144*b*) of the transfer roller to the toner pattern bearer at a center transfer nip. The supported portions of the transferor that exert the greater transfer nip pressure press the toner pattern bearer against the image bearer at the lateral end transfer nips more closely than the center portion does at the center transfer nip.

Lateral end contact areas where the toner pattern bearer contacts the image bearer at the lateral end transfer nips, respectively, are greater than a center contact area where the toner pattern bearer contacts the image bearer at the center transfer nip. Hence, an electric resistance of the respective lateral end transfer nips is smaller than an electric resistance of the center transfer nip. Accordingly, a transfer current flowing through the respective lateral end transfer nips is greater than a transfer current flowing through the center transfer nip.

An appropriate transfer current flowing through the transfer nip, that attains an appropriate transfer rate at the respective lateral end transfer nips where the transferor exerts greater transfer nip pressure to the toner pattern bearer, is smaller than an appropriate transfer current that attains an appropriate transfer rate at the center transfer nip where the transferor exerts smaller transfer nip pressure to the toner pattern bearer.

The transfer current flowing through the transfer nip is set to a value near the appropriate transfer current that attains the approximate transfer rate at the center transfer nip so as to enhance quality of a toner image situated at a center of a recording medium (e.g., the sheet P) in the main scanning direction. However, the appropriate transfer current for the center transfer nip formed by the center portion 114*b* is excessively high for the lateral end transfer nips formed by the supported portions 144*a* that press against the toner pattern bearer with greater transfer nip pressure and therefore is greater than the appropriate transfer current for the respective lateral end transfer nips. Thus, the lateral end transfer nips may suffer from excessive transfer of toner.

The excessive transfer defines a state in which a transfer current greater than the appropriate transfer current reverses a polarity of toner of the toner image and degrades the transfer rate. The transfer current flowing through the transfer nip is set to be slightly smaller than the appropriate transfer current flowing through the center transfer nip and near the appropriate transfer current flowing through the respective lateral end transfer nips, thus decreasing excessive transfer of toner at the lateral end transfer nips. Accordingly, a transfer rate at the respective lateral end transfer nips is slightly smaller than a transfer rate at the center transfer nip, suppressing variation in the toner density of the toner image in the main scanning direction.

However, as toner degradation progresses and a toner charge amount decreases, the appropriate transfer currents flowing through the center transfer nip and the lateral end transfer nips, respectively, tend to decrease. In this case also, since the transfer current set initially before toner degrades is slightly smaller than the appropriate transfer current for the center transfer nip, even if toner degradation progresses and the appropriate transfer current for the center transfer nip decreases gradually, the transfer current set before toner degrades is slightly greater than the appropriate transfer current. That is, even if toner degradation progresses, the transfer current applied to the center transfer nip is near the appropriate transfer current. Hence, the center transfer nip is immune from substantial decrease in the transfer rate.

Conversely, since an initial set value of the transfer current set for the supported portions before toner degradation progresses is slightly greater than the appropriate primary transfer current, as toner degradation progresses and the appropriate transfer current decreases gradually, the initial set value of the transfer current set before toner degradation progresses is even greater than the appropriate transfer current. Accordingly, as toner degradation progresses, the supported portions are more susceptible to excessive transfer, thus degrading the transfer rate substantially. Consequently, as toner degradation progresses, a difference in the transfer rate between the supported portions and the center portion of the transferor increases, thus generating variation in the toner density of the toner image (e.g., deviation in the toner adhesion amount) in the main scanning direction.

Since toner degradation correlates to deviation in the toner density of the toner image in the main scanning direction, the toner degradation rate is calculated by detecting deviation in the toner adhesion amount of toner adhered to the toner pattern bearer in the main scanning direction. However, deviation in the toner adhesion amount of toner adhered to the toner pattern bearer in the main scanning direction may result not only from toner degradation but also from variation in a toner charge amount of toner, an exposure amount of the image bearer, or the like in the main scanning direction. Accordingly, if the toner degradation rate calculator is configured to detect a toner adhesion amount of toner adhered to a single toner pattern formed on the toner pattern bearer at a plurality of positions on the single toner pattern in the main scanning direction and calculate a toner degradation rate based on deviation in the toner adhesion amount of toner adhered to the single toner pattern in the main scanning direction, even if toner does not degrade, the toner degradation rate calculator may erroneously calculate the toner degradation rate when deviation in the toner adhesion amount of toner adhered to the single toner pattern in the main scanning direction occurs due to reasons other than toner degradation, such as variation in the toner charge amount and the exposure amount of the image bearer in the main scanning direction.

To address this circumstance, according to the exemplary embodiments described above, the toner pattern bearer bears the first toner pattern having a first image area and the second toner pattern having a second image area different from the first image area. The first toner pattern and the second toner pattern are disposed at different positions on the toner pattern bearer in the sub-scanning direction and used for detecting the toner degradation rate.

The toner adhesion amount detector includes a plurality of sensors aligned in the main scanning direction to detect the toner adhesion amount of toner adhered to the first toner pattern and the second toner pattern at a plurality of different positions (e.g., the lateral end portions 143*a* and the center portion 143*b* depicted in FIG. 9) aligned on each of the first toner pattern and the second toner pattern in the main scanning direction. The toner degradation rate calculator calculates deviation in the toner adhesion amount of toner adhered to each of the first toner pattern and the second toner pattern based on the toner adhesion amount detected by the plurality of sensors. The toner degradation rate calculator compares the calculated deviation in the toner adhesion amount of toner adhered to the first toner pattern with the calculated deviation in the toner adhesion amount of toner adhered to the second toner pattern.

The following describes reasons for the comparison.

As the first toner pattern and the second toner pattern are adhered to the toner pattern bearer, the electric resistance at the transfer nip increases by an electric resistance of the first toner pattern and the second toner pattern. Since a transfer bias is under a constant current control, the transfer current flowing through the transfer nip is constant and a transfer voltage increases. The transfer current flowing through the transfer nip is divided into a transfer current flowing through the center transfer nip disposed opposite the center portion of the transfer roller and a transfer current flowing through the lateral end transfer nips disposed opposite the supported portions, respectively, of the transfer roller according to a ratio between an electric resistance of the center transfer nip and an electric resistance of the respective lateral end transfer nips.

Since the electric resistance of the respective lateral end transfer nips is smaller than the electric resistance of the center transfer nip, the transfer current flowing through the respective lateral end transfer nips is greater than the transfer current flowing through the center transfer nip. If a great toner pattern (e.g., the first toner pattern P1) having a relatively great image area adheres to the toner pattern bearer, the toner adhesion amount of toner adhered to the toner pattern bearer is relatively great. Hence, a relatively great amount of toner is interposed between the image bearer and the toner pattern bearer. Accordingly, the toner in the relatively great amount increases a separation force exerted to the toner pattern bearer in a direction in which the toner pattern bearer separates from the image bearer.

Since the supported portions of the transfer roller are supported with a support force against the separation force, lateral end transfer nip pressure exerted by the supported portions of the transfer roller to the toner pattern bearer increases substantially. Conversely, since the center portion of the transfer roller is not supported with the support force against the separation force, the support force bends the toner pattern bearer and releases center transfer nip pressure exerted by the center portion of the transfer roller to the toner pattern bearer. Accordingly, the center transfer nip pressure barely increases. Consequently, since the lateral end transfer nip pressure exerted by the supported portions of the transfer roller is substantially greater than the center transfer nip pressure exerted by the center portion of the transfer roller, the electric resistance at the respective lateral end transfer nips is substantially smaller than the electric resistance at the center transfer nip. Hence, a ratio between the electric resistance at the respective lateral end transfer nips and the electric resistance at the center transfer nip increases.

Accordingly, with the toner pattern having the relatively great image area, even if the transfer current flowing through the transfer nip is constant, the transfer current flows through the lateral end transfer nips more readily than the center transfer nip. Consequently, the transfer current flowing through the respective lateral end transfer nips is greater than the transfer current flowing through the center transfer nip, facilitating excessive transfer of toner at the lateral end transfer nips. Thus, the transfer rate at the respective lateral end transfer nips is substantially smaller than the transfer rate at the center transfer nip.

Conversely, with a small toner pattern (e.g., the second toner pattern P2) having a relatively small image area, a relatively small amount of toner is interposed between the image bearer and the toner pattern bearer. Accordingly, the lateral end transfer nip pressure exerted by the supported portions of the transfer roller to the toner pattern bearer barely increases. Hence, a difference between the lateral end transfer nip pressure and the center transfer nip pressure is relatively small.

A ratio between the electric resistance at the lateral end transfer nips and the electric resistance at the center transfer nip with the toner pattern having the relatively small image area is smaller than a ratio between the electric resistance at the respective lateral end transfer nips and the electric resistance at the center transfer nip with the toner pattern having the relatively great image area. Accordingly, the small toner pattern facilitates excessive transfer of toner at the lateral end transfer nips less than the great toner pattern. With the small toner pattern, the transfer rate at the respective lateral end transfer nips is not substantially smaller than the transfer rate at the center transfer nip, unlike with the great toner pattern.

As described above, the electric resistance at the transfer nip increases by the electric resistance of the first toner pattern and the second toner pattern. Accordingly, if the image area is relatively great, the electric resistance at the transfer nip is relatively great. Since the transfer current flowing through the transfer nip is constant, the transfer voltage is relatively great. The relatively great transfer voltage causes excessive transfer of toner. Since the transfer rate at the respective lateral end transfer nips is greater than the transfer rate at the center transfer nip, the lateral end transfer nips are susceptible to excessive transfer of toner. If the image area is relatively great, that is, with the first toner pattern P1, the relatively great image area facilitates excessive transfer of toner at the lateral end transfer nips, increasing a difference in the toner adhesion amount of toner adhered to the first toner pattern P1 between the center transfer nip and the lateral end transfer nips.

Conversely, if the image area is relatively small, that is, with the second toner pattern P2, since the transfer voltage is small, the relatively small image area suppresses excessive transfer of toner at the lateral end transfer nips, decreasing a difference in the toner adhesion amount of toner adhered to the second toner pattern P2 between the center transfer nip and the lateral end transfer nips. Accordingly, deviation in the toner adhesion amount of toner adhered to the toner pattern bearer in the main scanning direction, which appears when toner degradation progresses and the toner charge amount decreases, may be different between the first toner pattern P1 and the second toner pattern P2 that have different image areas, respectively.

To address this circumstance, the toner degradation rate calculator compares a first deviation in the toner adhesion amount of toner adhered to the first toner pattern P1 with a second deviation in the toner adhesion amount of toner adhered to the second toner pattern P2 in the main scanning direction. Thus, the toner degradation rate calculator identifies deviation in the toner adhesion amount of toner adhered to the toner pattern bearer in the main scanning direction, which is caused by a factor other than toner degradation, thus suppressing erroneous calculation of the toner degradation rate.

A description is provided of advantages of the image forming apparatus 1 in an aspect B.

In the aspect A, the toner image forming device includes a developing device (e.g., the developing device 125)

employing a developing method using a superimposed bias in which an alternating current voltage is superimposed on a direct current voltage.

If the toner charge amount is relatively small, an effect of a return bias to return toner to the image bearer as a developing condition using the superimposed bias is small, reducing prevention of white spots and an uneven color on the toner image. To address this circumstance, according to the aspect B, the toner degradation rate calculator increases a duty cycle relatively to increase the return bias according to the toner degradation rate detected precisely, thus increasing an application time period of a return bias voltage and enhancing evening of toner on the toner pattern bearer. Thus, the toner degradation rate calculator improves prevention of the white spots and the uneven color on the toner image without degrading quality of the toner image.

A description is provided of advantages of the image forming apparatus 1 in an aspect C.

In the aspect A or B, the transferor is supported by point support. According to the aspect C, the transferor includes a supported portion (e.g., the supported portions 144*a*) and a non-supported portion (e.g., the center portion 144*b*). The supported portion and the non-supported portion achieve different transfer rates, respectively, that deviate the toner adhesion amount of toner adhered to the toner pattern bearer substantially. To address this circumstance, the toner degradation rate calculator detects the toner degradation rate precisely.

A description is provided of advantages of the image forming apparatus 1 in an aspect D.

In any one of the aspects A to C, the transferor is under a constant current control. The first deviation in the toner adhesion amount of toner adhered to the first toner pattern having the first image area may be different from the second deviation in the toner adhesion amount of toner adhered to the second toner pattern having the second image area different from the first image area. To address this circumstance, the toner degradation rate calculator detects the toner degradation rate precisely.

A description is provided of advantages of the image forming apparatus 1 in an aspect E.

In any one of the aspects A to D, the toner image forming device forms the first toner image and the second toner image on the image bearer that are formed into the first toner pattern and the second toner pattern, respectively, on the toner pattern bearer, so that the transferor transfers the first toner image and the second toner image at least on an identical span on the toner pattern bearer in the direction perpendicular to the rotation direction of the toner pattern bearer. For example, as illustrated in FIG. 9, the second toner pattern P2 includes a plurality of toner patches P2A, P2B, and P2C aligned in the direction perpendicular to the rotation direction of the toner pattern bearer. The second toner pattern P2 including the toner patches P2A, P2B, and P2C is disposed in a span S143 in the direction perpendicular to the rotation direction of the toner pattern bearer. The first toner pattern P1 is also disposed in the span S143.

According to the aspect E, the toner degradation rate calculator compares the first deviation in the toner adhesion amount of toner adhered to the first toner pattern having the first image area with the second deviation in the toner adhesion amount of toner adhered to the second toner pattern having the second image area different from the first image area. Accordingly, the toner degradation rate calculator detects the first deviation and the second deviation with an improved precision for each of the first toner pattern and the second toner pattern, thus detecting the toner degradation rate precisely.

A description is provided of advantages of the image forming apparatus 1 in an aspect F.

In any one of the aspects A to E, the transferor includes a transfer roller (e.g., the primary transfer roller 144) supported at both lateral ends of the transfer roller in an axial direction thereof perpendicular to the rotation direction of the toner pattern bearer. As illustrated in FIG. 9, the transfer roller includes a center portion (e.g., the center portion 144*b*) disposed opposite a center portion (e.g., the center portion 143*b*) of the toner pattern bearer in the direction perpendicular to the rotation direction of the toner pattern bearer and supported portions (e.g., the supported portions 144*a*) disposed opposite both lateral end portions (e.g., the lateral end portions 143*a*) of the toner pattern bearer, respectively, in the direction perpendicular to the rotation direction of the toner pattern bearer.

The toner image forming device forms the first toner image and the second toner image on the image bearer such that the first toner image and the second toner image are transferred onto the toner pattern bearer, as the first toner pattern and the second toner pattern, respectively, on at least two different positions on the toner pattern bearer in the direction perpendicular to the rotation direction of the toner pattern bearer. The at least two positions are on the center portion and the lateral end portion of the toner pattern bearer. According to the aspect F, the toner adhesion amount of toner adhered to the toner pattern bearer differs substantially between the center portion and both lateral end portions of the toner pattern bearer, enhancing a sensitivity in detecting a difference in the toner adhesion amount between the center portion and both lateral end portions of the toner pattern bearer. Accordingly, the toner degradation rate calculator detects the first deviation in the toner adhesion amount of toner adhered to the first toner pattern having the first image area and the second deviation in the toner adhesion amount of toner adhered to the second toner pattern having the second image area different from the first image area with an improved precision, thus detecting the toner degradation rate precisely.

A description is provided of advantages of the image forming apparatus 1 in an aspect G.

In any one of the aspects A to F, the toner image forming device forms solid images on the image bearer such that the solid images are transferred onto the toner pattern bearer, as the first toner pattern and the second toner pattern, respectively. A distribution of deviation in the toner adhesion amount of toner adhered to the toner pattern bearer varies between a solid image and a halftone image. Accordingly, both the first toner pattern having the first image area and the second toner pattern having the second image area different from the first image area are formed of one of the solid image and the halftone image.

Since the solid image is applied with a relatively great transfer voltage, the toner degradation rate calculator detects the first deviation in the toner adhesion amount of toner adhered to the first toner pattern and the second deviation in the toner adhesion amount of toner adhered to the second toner pattern with an increased sensitivity, thus detecting the difference between the first deviation in the toner adhesion amount of toner adhered to the first toner pattern and the second deviation in the toner adhesion amount of toner adhered to the second toner pattern with an enhanced sensitivity. Accordingly, the toner degradation rate calculator detects the first deviation in the toner adhesion amount of toner adhered to the first toner pattern having the first image area and the second deviation in the toner adhesion amount of toner adhered to the second toner pattern having the second image area different from the first image area with an improved precision, thus detecting the toner degradation rate precisely.

A description is provided of advantages of the image forming apparatus 1 in an aspect H.

In any one of the aspects A to G, the image forming apparatus further includes a developing condition determiner 22 connected to the toner degradation rate calculator 21 and the developing device 125 serving as the toner image forming device. The developing condition determiner 22 serves as a developing condition determiner that determines a developing condition of the toner image forming device in the developing method using the superimposed bias in which the alternating current voltage is superimposed on the direct current voltage based on the toner degradation rate calculated by the toner degradation rate calculator. According to the aspect H, the developing condition determiner determines the developing condition based on the toner degradation rate, retaining prevention of the white spots and the uneven color of the toner image.

A description is provided of advantages of the image forming apparatus 1 in an aspect I.

In the aspect H, the developing condition in the developing method using the superimposed bias in which the alternating current voltage is superimposed on the direct current voltage includes at least one of factors such as a frequency of the superimposed bias, a difference between a maximum value and a minimum value of a superimposed bias voltage, and a duty cycle of the superimposed bias. According to the aspect I, based on the calculated toner degradation rate, the toner degradation rate calculator adjusts at least one of the frequency of the superimposed bias, the difference between the maximum value and the minimum value of the superimposed bias voltage, and the duty cycle of the superimposed bias. Thus, the developing condition using the superimposed bias is adjusted with an increased flexibility.

A description is provided of advantages of the image forming apparatus 1 in the aspect J.

In any one of the aspects A to I, the image forming apparatus further includes a transfer condition determiner 23 connected to the toner degradation rate calculator 21 and the primary transfer roller 144 serving as a transferor. The transfer condition determiner 23 serves as a transfer condition determiner that determines a transfer condition of the transferor based on the toner degradation rate calculated by the toner degradation rate calculator.

According to the aspect J, if the toner degradation rate calculated by the toner degradation rate calculator is small, for example, the transfer condition determiner increases a set value of the transfer current, for example, as the transfer condition in view of a transfer efficiency, thus enhancing the transfer rate at the transfer nip, that has a close correlation to the transfer current. Conversely, if the toner degradation rate is great, for example, the transfer condition determiner decreases the set value of the transfer current to reduce excessive transfer of toner at the lateral end transfer nips and decrease variation in the toner density of the toner image in the main scanning direction (e.g., deviation in the toner adhesion amount of toner adhered to the toner pattern bearer in the main scanning direction).

A description is provided of advantages of the image forming apparatus 1 in an aspect K.

In the aspect J, if the toner degradation rate calculated by the toner degradation rate calculator is smaller than a reference value calculated with an initial developer at an ambient temperature, the transfer condition determiner increases the set value of the transfer current applied to the transferor. Conversely, if the toner degradation rate calculated by the toner degradation rate calculator is greater than the reference value calculated with the initial developer at the ambient temperature, the transfer condition determiner decreases the set value of the transfer current applied to the transferor.

According to the aspect K, if the toner degradation rate calculated by the toner degradation rate calculator is relatively small and the toner charge amount is relatively great, even if the transfer condition determiner increases the set value of the transfer current, the lateral end transfer nips are barely susceptible to excessive transfer. Accordingly, if the toner degradation rate is relatively small, the transfer condition determiner increases the set value of the transfer current, thus enhancing the transfer rate at the transfer nip, which has a close correlation to the transfer current.

Conversely, if the toner degradation rate is relatively great and the toner charge amount is relatively small, the transfer current flowing through the transfer nip decreases. Accordingly, the transfer current flowing through the lateral end transfer nips increases, facilitating excessive transfer of toner and increasing variation in the toner density of the toner image in the main scanning direction. To address this circumstance, if the toner degradation rate is relatively great, the transfer condition determiner decreases the set value of the transfer current to reduce excessive transfer of toner at the lateral end transfer nips and decrease variation in the toner density of the toner image in the main scanning direction.

A description is provided of advantages of the image forming apparatus 1 in an aspect L.

In any one of the aspects A to K, as illustrated in FIG. 19, the controller 10 further includes a background potential adjuster 24 connected to the toner degradation rate calculator 21, the developing device 125, and the charger 123. The background potential adjuster 24 serves as a background potential adjuster that adjusts a background potential defining a potential difference between a charging potential of an outer circumferential surface of the image bearer and a developing bias applied to the toner image forming device (e.g., the developing device 125) based on the toner degradation rate calculated by the toner degradation rate calculator. If the toner degradation rate calculated by the toner degradation rate calculator is relatively small, the background potential adjuster decreases the background potential to a relatively small value. Conversely, if the toner degradation rate calculated by the toner degradation rate calculator is relatively great, the background potential adjuster increases the background potential to a relatively great value.

As the background potential increases, the increased background potential reduces a fog (e.g., background stains). On the other hand, as the background potential increases, the increased background potential increases white spots produced by carrier particles adhered to a halftone image. If the toner degradation rate calculated by the toner degradation rate calculator is relatively small and the toner charge amount is relatively great, a leeway to be immune from the fog increases while a leeway to be immune from the white spots on the halftone image decreases. When the toner image forming device develops an electrostatic latent image into a halftone image, as an edge effect is applied to the halftone image, an electric field of an edge portion of the halftone image is greater than an electric field of a line portion of the halftone image that is inboard from the edge portion. If the toner degradation rate is relatively small and the toner charge amount is relatively great, an amount of carrier particles adhered to the edge portion increases, producing a substantial amount of white spots on the halftone image. Conversely, if the toner degradation rate calculated by the toner degradation rate calculator is relatively great and the toner charge amount is relatively small, the leeway to be immune from the white spots on the halftone image increases. However, toner is susceptible to adhesion to a background portion of the image bearer, increasing the fog. Hence, the leeway to be immune from the fog decreases.

According to the aspect L, if the toner degradation rate calculated by the toner degradation rate calculator is relatively small and the toner charge amount is relatively great, the background potential adjuster decreases the charging potential of the image bearer uniformly charged to a relatively small value, for example, thus decreasing the background potential to a relatively small value. Since the leeway to be immune from the fog increases, the background potential adjuster suppresses adhesion of the carrier particles to the edge portion of the halftone image due to the edge effect on the halftone image and generation of the white spots on the halftone image, thus attaining the leeway to be immune from the white spots on the halftone image. Conversely, if the toner degradation rate calculated by the toner degradation rate calculator is relatively great and the toner charge amount is relatively small, the background potential adjuster increases the charging potential of the image bearer uniformly charged to a relatively great value, for example, thus increasing the background potential to a relatively great value. Since the leeway to be immune from the white spots on the halftone image is relatively great, the background potential adjuster suppresses the fog, thus attaining the leeway to be immune from the fog.

According to the exemplary embodiments described above, the background potential, the toner charge amount, or the charging bias being relatively small or great may indicate that the background potential, the toner charge amount, or the charging bias is smaller or greater than the reference value determined with the initial developer at the ambient temperature. The toner degradation rate being relatively small or great may indicate that the toner degradation rate is smaller or greater than the reference value calculated with the initial developer at the ambient temperature.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. An image forming apparatus, comprising:

an image bearer;

a toner image forming device to form a first toner image and a second toner image on the image bearer, the toner image forming device including a developing device that employs a developing method using a superimposed bias in which an alternating current voltage is superimposed on a direct current voltage;

a toner pattern bearer rotatable in a predetermined direction of rotation;

a transferor to transfer the first toner image onto a first position on the toner pattern bearer as a first toner pattern having a first image area, and transfer the second toner image onto a second position on the toner pattern bearer as a second toner pattern having a second image area different from the first image area, the second position being spaced apart from the first position in the direction of rotation of the toner pattern bearer;

a toner adhesion amount detector to detect a toner adhesion amount of toner of each of the first toner pattern and the second toner pattern at a plurality of different positions aligned in a direction perpendicular to the direction of rotation of the toner pattern bearer;

a toner degradation rate calculator to calculate a first deviation in the toner adhesion amount of the first toner pattern and a second deviation in the toner adhesion amount of the second toner pattern based on the toner adhesion amount detected by the toner adhesion amount detector at the plurality of different positions, compare the first deviation with the second deviation, and calculate a toner degradation rate based on a comparison result; and a developing condition determiner to determine a developing condition in the developing method based on the toner degradation rate calculated by the toner degradation rate calculator, wherein the developing condition includes at least one of a frequency of the superimposed bias, a difference between a maximum value and a minimum value of a superimposed bias voltage, and a duty cycle of the superimposed bias.

2. The image forming apparatus according to claim 1, wherein the transferor is supported by point support.

3. The image forming apparatus according to claim 1, wherein the transferor is under a constant current control.

4. The image forming apparatus according to claim 1, wherein each of the first toner pattern and the second toner pattern is disposed in an identical span in the direction perpendicular to the direction of rotation of the toner pattern bearer.

5. The image forming apparatus according to claim 4, wherein the second toner pattern includes a plurality of toner patches aligned in the direction perpendicular to the direction of rotation of the toner pattern bearer.

6. The image forming apparatus according to claim 1, wherein the transferor includes a transfer roller supported at both lateral ends of the transfer roller in an axial direction perpendicular to the direction of rotation of the toner pattern bearer.

7. The image forming apparatus according to claim 6, wherein the transfer roller includes:

a supported portion to press the toner pattern bearer against the image bearer with a first pressure; and a non-supported portion to press the toner pattern bearer against the image bearer with a second pressure smaller than the first pressure.

8. The image forming apparatus according to claim 7, wherein the non-supported portion of the transfer roller is disposed opposite a center portion of the toner pattern bearer in the direction perpendicular to the direction of rotation of the toner pattern bearer, and the supported portion of the transfer roller is disposed opposite both lateral end portions of the toner pattern bearer in the direction perpendicular to the direction of rotation of the toner pattern bearer.

9. The image forming apparatus according to claim 8, wherein the second toner pattern is at least on the center portion and one of the both lateral end portions of the toner pattern bearer.

10. The image forming apparatus according to claim 1, wherein each of the first toner image and the second toner image includes a solid image.

11. The image forming apparatus according to claim 1, further comprising a background potential adjuster to adjust a background potential defining a potential difference between a charging potential of an outer circumferential surface of the image bearer and a developing bias applied to the developing device based on the toner degradation rate calculated by the toner degradation rate calculator.

12. The image forming apparatus according to claim 11, wherein when the toner degradation rate calculated by the toner degradation rate calculator is smaller than a reference value, the background potential adjuster decreases the background potential, and when the toner degradation rate is greater than the reference value, the background potential adjuster increases the background potential.

13. The image forming apparatus according to claim 1, further comprising a transfer condition determiner to determine a transfer condition of the transferor based on the toner degradation rate calculated by the toner degradation rate calculator.

14. The image forming apparatus according to claim 13, wherein when the toner degradation rate calculated by the toner degradation rate calculator is smaller than a reference value, the transfer condition determiner increases a set value of a transfer current applied to the transferor.

15. The image forming apparatus according to claim 14, wherein when the toner degradation rate calculated by the toner degradation rate calculator is greater than the reference value, the transfer condition determiner decreases the set value of the transfer current applied to the transferor.

16. An image forming method, comprising:

forming, by a toner forming device, a first toner pattern having a first image area and a second toner pattern having a second image area smaller than the first image area on a toner pattern bearer, the toner forming device including a developing device that employs a developing method using a superimposed bias in which an alternating current voltage is superimposed on a direct current voltage;

detecting a toner adhesion amount of toner adhered to the first toner pattern and the second toner pattern at a plurality of positions aligned on each of the first toner pattern and the second toner pattern in a main scanning direction perpendicular to a direction of rotation of the toner pattern bearer;

calculating a difference between a first deviation in the toner adhesion amount of the first toner pattern and a second deviation in the toner adhesion amount of the second toner pattern in the main scanning direction;

calculating a toner degradation rate based on the calculated difference; and determining a developing condition in the developing method based on the calculated toner degradation rate, wherein the developing device uses the developing condition in the developing method to form a toner image, and the developing condition includes at least one of a frequency of the superimposed bias, a difference between a maximum value and a minimum value of a superimposed bias voltage, and a duty cycle of the superimposed bias.

17. An image forming apparatus, comprising:

a toner image forming device to form toner images, the toner image forming device including a developing device that employs a developing method using a superimposed bias in which an alternating current voltage is superimposed on a direct current voltage;

a toner pattern bearer rotatable along an axis;

a transferor to transfer a first toner image onto a first position on the toner pattern bearer as a first toner pattern having a first image area, and transfer a second toner image onto a second position on the toner pattern bearer as a second toner pattern having a second image area different from the first image area, the second position being spaced apart from the first position in a direction of rotation of the toner pattern bearer;

a toner adhesion amount detector to detect a toner adhesion amount of toner of each of the first toner pattern and the second toner pattern at a plurality of different positions aligned in a direction perpendicular to the direction of rotation;

a toner degradation rate calculator to calculate a first deviation in the toner adhesion amount of the first toner pattern and a second deviation in the toner adhesion amount of the second toner pattern based on the toner adhesion amount detected at the plurality of different positions, and calculate a toner degradation rate based on a comparison of the first deviation with the second deviation; and a developing condition determiner to determine, based on the toner degradation rate, a developing condition for the developing method the developing condition including at least one of a frequency of the superimposed bias, a difference between a maximum value and a minimum value of a superimposed bias voltage, and a duty cycle of the superimposed bias.

18. The image forming apparatus according to claim 17, wherein the first toner pattern and the second toner pattern are disposed in an identical span in the direction perpendicular to the direction of rotation.

19. The image forming apparatus according to claim 17, wherein the second toner pattern includes a plurality of toner patches aligned in the direction perpendicular to the direction of rotation.

20. The image forming apparatus according to claim 17, wherein the transferor includes a transfer roller supported at both lateral ends of the transfer roller in an axial direction perpendicular to the direction of rotation.

* * * * *